US012729899B2

(12) United States Patent
Shibuya et al.

(10) Patent No.: US 12,729,899 B2
(45) Date of Patent: Sep. 8, 2026

(54) AIR CONTROL SYSTEM, REFRIGERATION APPARATUS, AND TRANSPORT CONTAINER

(71) Applicant: DAIKIN INDUSTRIES, LTD., Osaka (JP)

(72) Inventors: Kento Shibuya, Osaka (JP); Wataru Hirata, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 123 days.

(21) Appl. No.: 18/743,140

(22) Filed: Jun. 14, 2024

(65) Prior Publication Data

US 2024/0328700 A1 Oct. 3, 2024

Related U.S. Application Data

(63) Continuation of application No. PCT/JP2022/045436, filed on Dec. 9, 2022.

(30) Foreign Application Priority Data

Dec. 14, 2021 (JP) ..... 2021-202327

(51) Int. Cl.
*F25D 17/04* (2006.01)
*F25D 11/00* (2006.01)

(52) U.S. Cl.
CPC ..... *F25D 17/042* (2013.01); *F25D 11/003* (2013.01)

(58) Field of Classification Search
CPC ..... F25D 17/042; F25D 11/003; F25D 2317/0411; F25D 11/00; B01D 2315/22; B01D 53/26; F24F 2003/1435; F24F 3/14
(Continued)

(56) References Cited

U.S. PATENT DOCUMENTS 5,457,963 A * 10/1995 Cahill-O'Brien ..... F24F 11/63 99/468
8,122,738 B2 * 2/2012 Saul ..... F25D 17/06 62/274

(Continued)

FOREIGN PATENT DOCUMENTS

CN 1646208 A 7/2005
CN 112105878 A 12/2020

(Continued)

OTHER PUBLICATIONS

Extended European search report issued on Feb. 6, 2025, in corresponding European patent Application No. 22907380.4, 6 pages.

(Continued)

*Primary Examiner* — Steve S Tanenbaum
(74) *Attorney, Agent, or Firm* — XSENSUS LLP

(57) ABSTRACT

An air control system includes a dehumidifying unit and a composition adjuster. The dehumidifying unit has a first separation membrane through which water vapor permeates, and dehumidifies target air. The composition adjuster has a second separation membrane, and separates the target air dehumidified by the dehumidifying unit into first air and second air having different compositions. The air control system supplies the first air or second air having flowed out of the composition adjuster to a storage.

8 Claims, 16 Drawing Sheets

(58) Field of Classification Search
USPC ..... 62/44, 440
See application file for complete search history.

(56) References Cited

U.S. PATENT DOCUMENTS

| | | | |
|---|---|---|---|
| 2021/0033295 | A1 | 2/2021 | Kamei et al. |
| 2022/0357057 | A1 | 11/2022 | Kamei et al. |

FOREIGN PATENT DOCUMENTS

| | | | | |
|---|---|---|---|---|
| JP | S56-101534 | A | 8/1981 | |
| JP | H08-000168 | A | 1/1996 | |
| JP | 2000-009611 | A | 1/2000 | |
| JP | 2003-205219 | A | 7/2003 | |
| JP | 2014-004521 | A | 1/2014 | |
| JP | 2019-196899 | A | 11/2019 | |
| KR | 20-0279934 | Y1 | 7/2002 | |
| WO | 03/086874 | A2 | 10/2003 | |
| WO | WO-2019216312 | A1 * | 11/2019 | ..... F24F 6/14 |

OTHER PUBLICATIONS

International Search Report and Written Opinion mailed on Jan. 31, 2023, received for International Application No. PCT/JP2022/045436, filed on Dec. 9, 2022, 10 pages including English Translation.

English translation of International Preliminary Report on Patentability (Chapter I) mailed on Jun. 27, 2024, in corresponding PCT/JP2022/045436, 7 pages.

* cited by examiner

AIR CONTROL SYSTEM, REFRIGERATION APPARATUS, AND TRANSPORT CONTAINER

CROSS-REFERENCE TO RELATED APPLICATIONS

This application is a continuation application of International Application No. PCT/JP2022/045436, filed Dec. 9, 2022, which claims priority to Japanese Patent Application No. 2021-202327, filed Dec. 14, 2021, the contents of these applications are incorporated herein by reference in their entirety.

TECHNICAL FIELD

The present disclosure relates to an air control system, a refrigeration apparatus, and a transport container.

BACKGROUND ART

Patent Document 1 discloses an internal environment control system configured to adjust the oxygen concentration of inside air. This system separates atmospheric air into nitrogen-enriched gas and oxygen-enriched gas using a separation membrane, and supplies the nitrogen-enriched gas into a storage to make the oxygen concentration of a storage lower than the oxygen concentration of the atmospheric air.

CITATION LIST

Patent Document

Patent Document 1: Japanese Unexamined Patent Publication No. H08-000168

SUMMARY

A first aspect of the present disclosure is directed to an air control system (100) for adjusting a composition of inside air in a storage (2), the air control system (100) including a dehumidifying unit (130) having a first separation membrane (134) for allowing water vapor to permeate therethrough and configured to dehumidify target air, and a composition adjuster (120) having a second separation membrane (124) for separating the target air dehumidified by the dehumidifying unit (130) into first air and second air having different compositions. The first air or second air having flowed out of the composition adjuster (120) is supplied to the storage (2).

DESCRIPTION OF EMBODIMENTS

Embodiments of the present disclosure will be described in detail below with reference to the drawings. The present disclosure is not limited to the embodiments shown below, and various changes can be made within the scope without departing from the technical concept of the present disclosure. Since each of the drawings is intended to illustrate the present disclosure conceptually, dimensions, ratios, or numbers may be exaggerated or simplified as necessary for the sake of ease of understanding.

First Embodiment

A first embodiment will be described below.

(1) Outline of Transport Container

The present disclosure relates to a transport container (1). The transport container (1) is a reefer container capable of controlling the internal temperature thereof. The transport container (1) is used to transport fresh products such as fruits, vegetables, and flowers and ornamental plants. The fresh products absorb oxygen ($O_2$) in the air and release carbon dioxide ($CO_2$).

Figure 1:
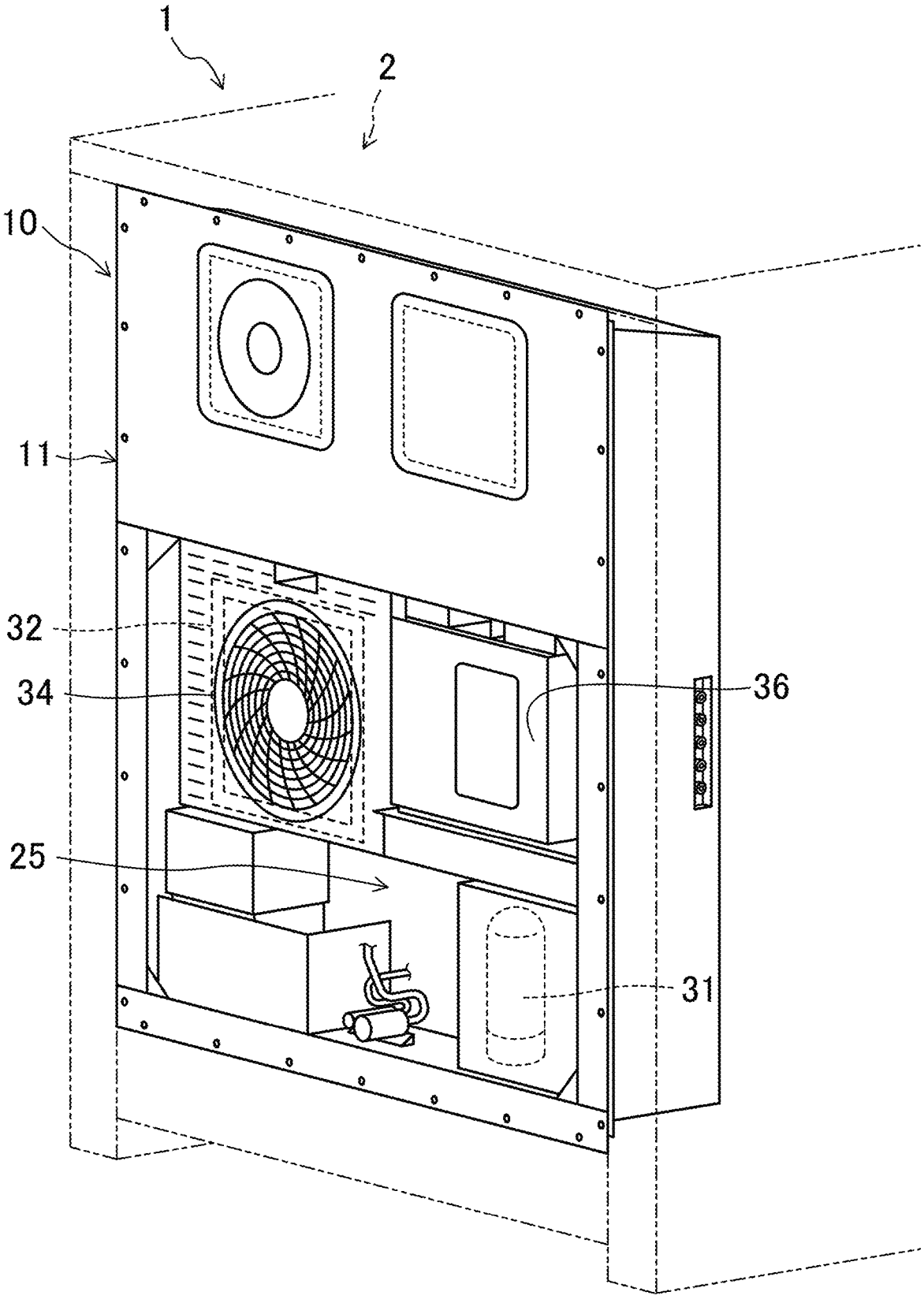
FIG. 1 is a perspective view of a transport container of a first embodiment, as viewed from the front.
Figure 5:
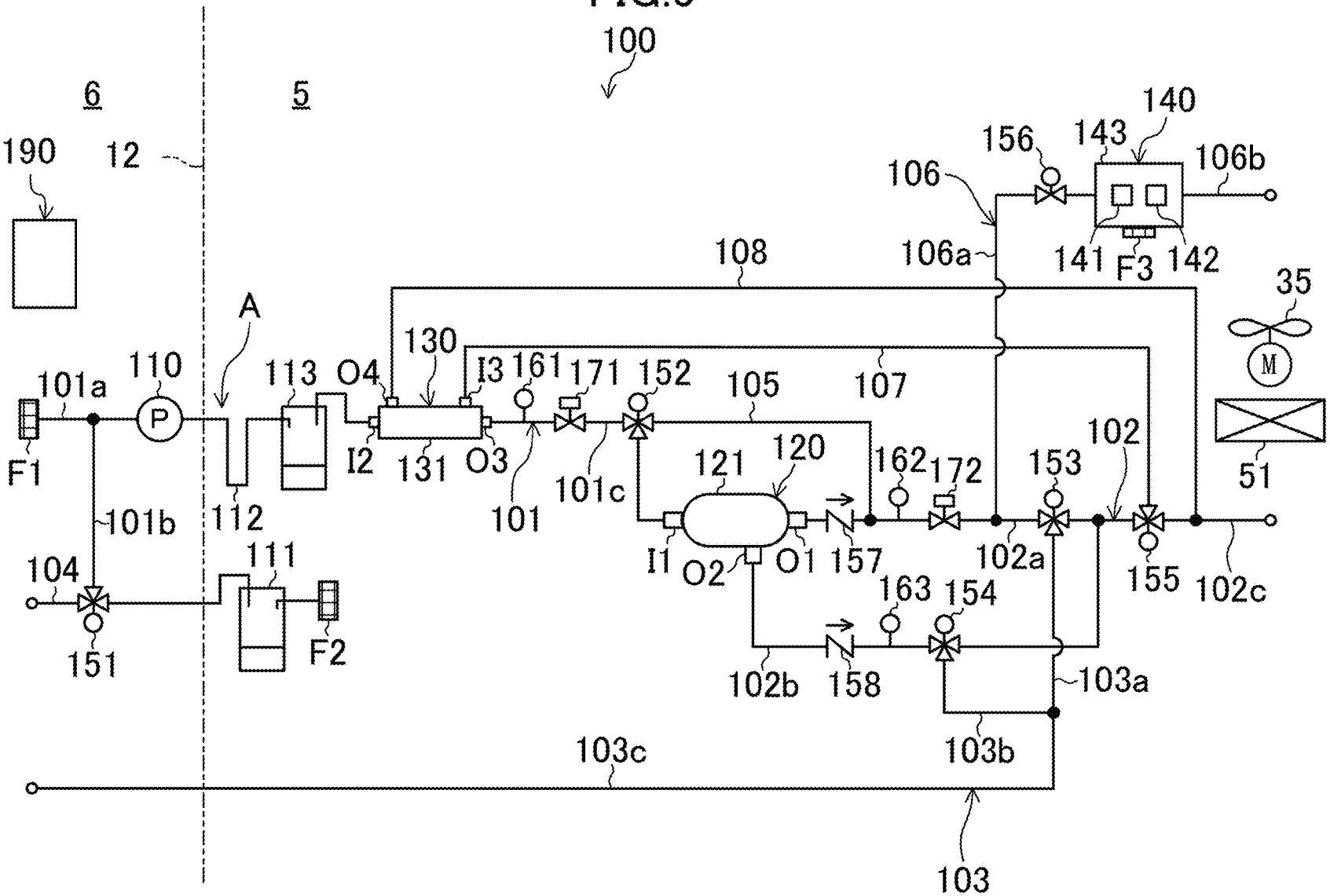
FIG. 5 is a piping system diagram illustrating the configuration of an air control system of the first embodiment.

As illustrated in FIG. 1, the transport container (1) includes a container body (2) and a refrigeration apparatus (10) for transport provided in the container body (2). The transport container (1) is used for marine transportation. The transport container (1) is conveyed by a marine transporter such as a ship. As illustrated in FIG. 5, the transport container (1) includes an air control system (100). The air control system (100) adjusts the composition of air in the container body (2).

(2) Container Body

The container body (2) is a storage for storing the fresh products.

The container body (2) is formed in a hollow box-like shape. The container body (2) is formed to be horizontally long. The container body (2) has an opening formed at one end in the longitudinal direction. The refrigeration apparatus (10) for transport closes the opening of the container body (2). The container body (2) forms therein a storage space (5) serving as an internal space for storing objects to be transported.

(3) Refrigeration Apparatus for Transport

The refrigeration apparatus (10) for transport is attached to the opening of the container body (2). The refrigeration apparatus (10) for transport includes a casing (11) and a refrigerant circuit (30). The refrigeration apparatus (10) for transport adjusts the temperature of air (inside air) in the storage space (5).

(3-1) Casing

Figure 2:
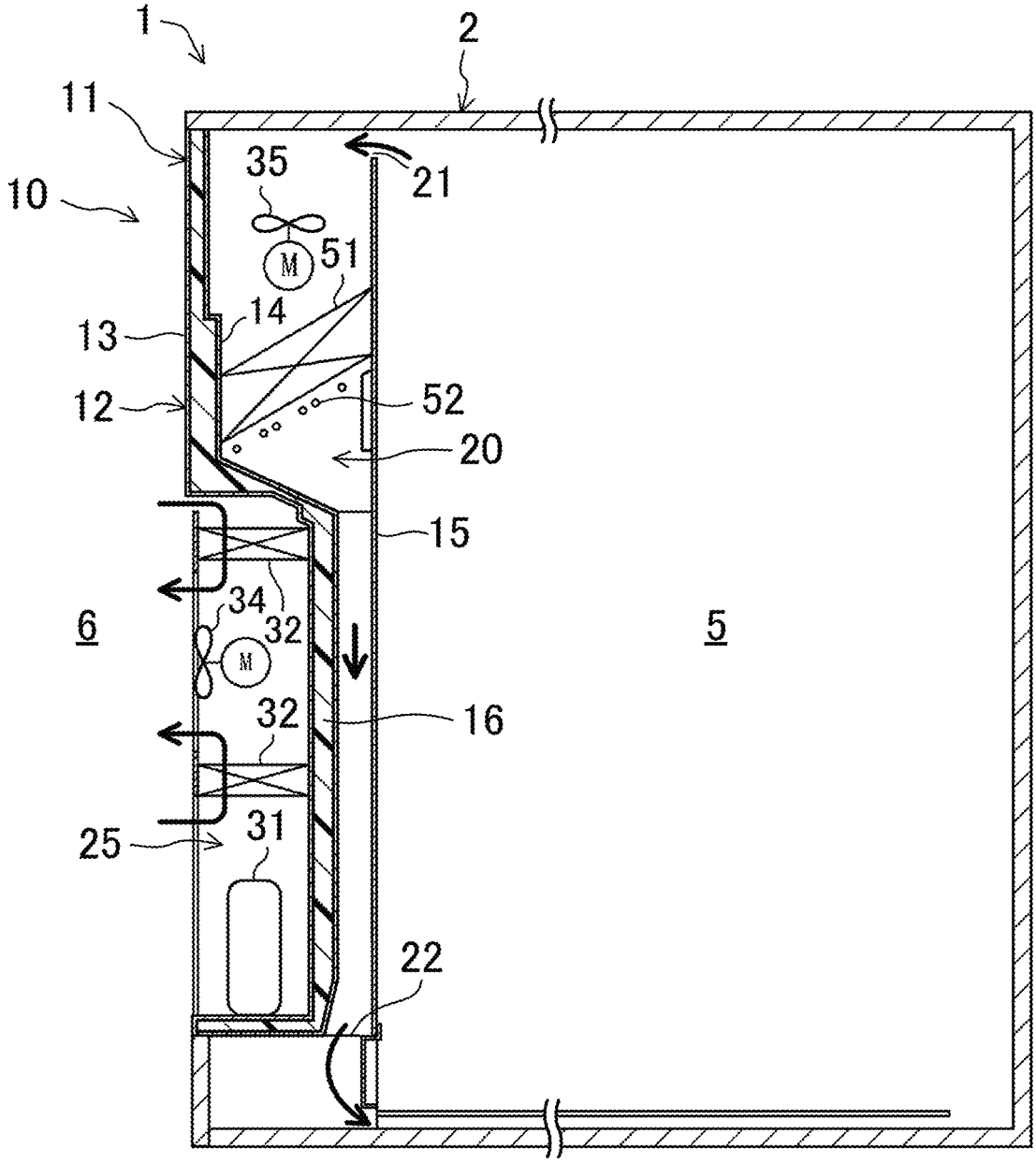
FIG. 2 is a longitudinal sectional view schematically illustrating an internal structure of the transport container of the first embodiment.

As illustrated in FIG. 2, the casing (11) includes a division wall (12) and a partition plate (15).

An internal flow path (20) is formed inside the division wall (12). An external chamber (25) serving as part of an external space (6) is formed outside the division wall (12). The internal flow path (20) and the external chamber (25) are separated by the division wall (12).

The division wall (12) includes an external wall (13) and an internal wall (14). The external wall (13) is located outside the container body (2). The internal wall (14) is located inside the container body (2).

The external wall (13) closes the opening of the container body (2). The external wall (13) is attached to a peripheral portion of the opening of the container body (2). A lower portion of the external wall (13) bulges inward of the container body (2). The external chamber (25) is formed inside the bulging external wall (13).

The internal wall (14) faces the external wall (13). The internal wall (14) has a shape along the external wall (13). A thermal insulator (16) is provided between the internal wall (14) and the external wall (13).

The partition plate (15) is arranged further inward of the container body (2) than the internal wall (14). The internal flow path (20) is formed between the division wall (12) and the partition plate (15). An inflow port (21) is formed between the upper end of the partition plate (15) and a top panel of the container body (2). An outflow port (22) is formed between the lower end of the partition plate (15) and the lower end of the division wall (12). The internal flow path (20) extends from the inflow port (21) to the outflow port (22).

(3-2) Components of Refrigerant Circuit

The refrigerant circuit (30) is filled with a refrigerant. The refrigerant circulates in the refrigerant circuit (30) to perform a vapor compression refrigeration cycle. The refrigerant circuit (30) includes a compressor (31), an external heat exchanger (32), an expansion valve (33), an internal heat exchanger (51), and a refrigerant pipe connecting these components.

The compressor (31) is arranged in a lower portion of the external chamber (25). The external heat exchanger (32) is arranged in an upper portion of the external chamber (25). The external heat exchanger (32) is a fin-and-tube heat exchanger configured to exchange heat between a refrigerant and outside air. The external heat exchanger (32) has a generally rectangular tubular shape. The internal heat exchanger (51) is arranged in the internal flow path (20). The internal heat exchanger (51) is a fin-and-tube heat exchanger configured to exchange heat between a refrigerant and inside air.

(3-3) External Fan and Internal Fan

The refrigeration apparatus (10) for transport includes a single external fan (34). The external fan (34) is a propeller fan. The external fan (34) is arranged in the external chamber (25). The external fan (34) is arranged inside the external heat exchanger (32) having a tubular shape. The external fan (34) sends outside air to the external heat exchanger (32).

The refrigeration apparatus (10) for transport includes two internal fans (35). The internal fans (35) are propeller fans. The internal fans (35) are arranged in the internal flow path (20). The internal fans (35) are arranged above the internal heat exchanger (51). The internal fans (35) send inside air to the internal heat exchanger (51).

(3-4) Heater

The refrigeration apparatus (10) for transport includes a heater (52). The heater (52) is arranged below the internal heat exchanger (51). The heater (52) is used to defrost the internal heat exchanger (51).

(3-5) Electric Component Box

As illustrated in FIG. 1, the refrigeration apparatus (10) for transport includes an electric component box (36). The electric component box (36) is arranged in an upper portion of the external chamber (25). The electric component box (36) houses electric components such as an inverter board and a control board.

(3-6) Configuration of Refrigerant Circuit

Figure 3:
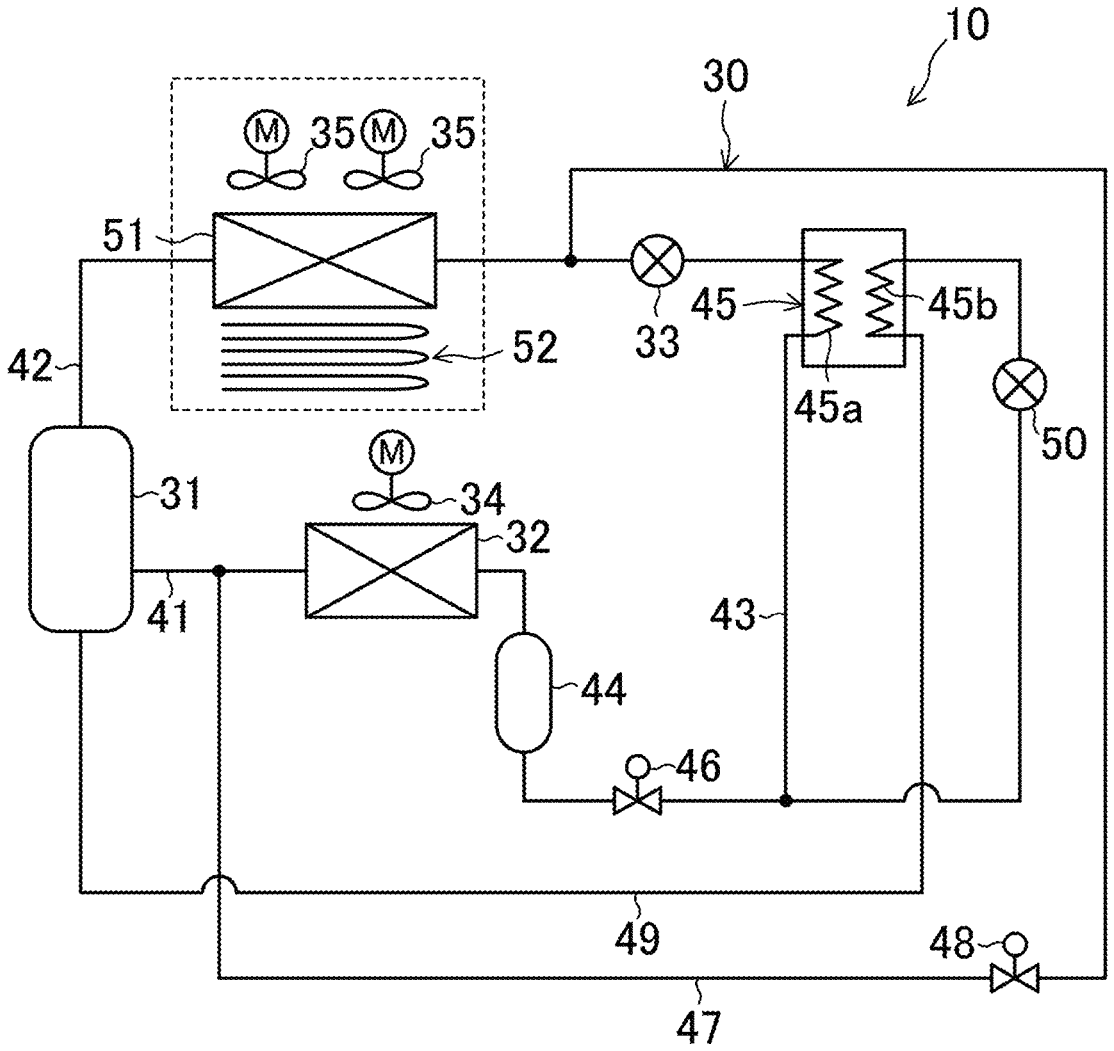
FIG. 3 is a piping system diagram of a refrigerant circuit of a refrigeration apparatus for transport according to the first embodiment.

As illustrated in FIG. 3, the refrigerant circuit (30) has, as main components, the compressor (31), the external heat exchanger (32), the expansion valve (33), and the internal heat exchanger (51). The expansion valve (33) is an electronic expansion valve having a variable opening degree.

The refrigerant circuit (30) has a discharge pipe (41) and a suction pipe (42). One end of the discharge pipe (41) is connected to a discharge portion of the compressor (31). The other end of the discharge pipe (41) is connected to a gas end of the external heat exchanger (32). One end of the suction pipe (42) is connected to a suction portion of the compressor (31). The other end of the suction pipe (42) is connected to a gas end of the internal heat exchanger (51).

The refrigerant circuit (30) has a liquid pipe (43), a receiver (44), a cooling heat exchanger (45), a first on-off valve (46), a connecting pipe (47), a second on-off valve (48), an injection pipe (49), and an injection valve (50).

One end of the liquid pipe (43) is connected to a liquid end of the external heat exchanger (32). The other end of the liquid pipe (43) is connected to a liquid end of the internal heat exchanger (51). The receiver (44) is provided for the liquid pipe (43). The receiver (44) is a container for storing a refrigerant.

The cooling heat exchanger (45) has a first flow path (45*a*) and a second flow path (45*b*). The cooling heat exchanger (45) exchanges heat between the refrigerant in the first flow path (45*a*) and the refrigerant in the second flow path (45*b*). The cooling heat exchanger (45) is, for example, a plate heat exchanger. The first flow path (45*a*) is part of the liquid pipe (43). The second flow path (45*b*) is part of the injection pipe (49). The cooling heat exchanger (45) cools the refrigerant flowing in the liquid pipe (43).

The first on-off valve (46) is provided in the liquid pipe (43) between the receiver (44) and the first flow path (45*a*). The first on-off valve (46) is an electromagnetic valve which can be opened and closed.

The connecting pipe (47) allows a high-pressure line and a low-pressure line of the refrigerant circuit (30) to communicate with each other. One end of the connecting pipe (47) is connected to the discharge pipe (41). The other end of the connecting pipe (47) is connected to a portion of the liquid pipe (43) between the expansion valve (33) and the internal heat exchanger (51).

The second on-off valve (48) is provided for the connecting pipe (47). The second on-off valve (48) is an electromagnetic valve which can be opened and closed.

The injection pipe (49) introduces the refrigerant into an intermediate-pressure portion of the compressor (31). One end of the injection pipe (49) is connected to a portion of the liquid pipe (43) between the receiver (44) and the first flow path (45*a*). The other end of the injection pipe (49) is connected to the intermediate-pressure portion of the compressor (31). An intermediate pressure, which is the pressure of the intermediate-pressure portion, is a pressure higher than the suction pressure and lower than the discharge pressure of the compressor (31). The injection valve (50) is provided upstream of the second flow path (45*b*) in the injection pipe (49). The injection valve (50) is an electronic expansion valve having a variable opening degree.

(3-7) First Control Unit

Figure 4:
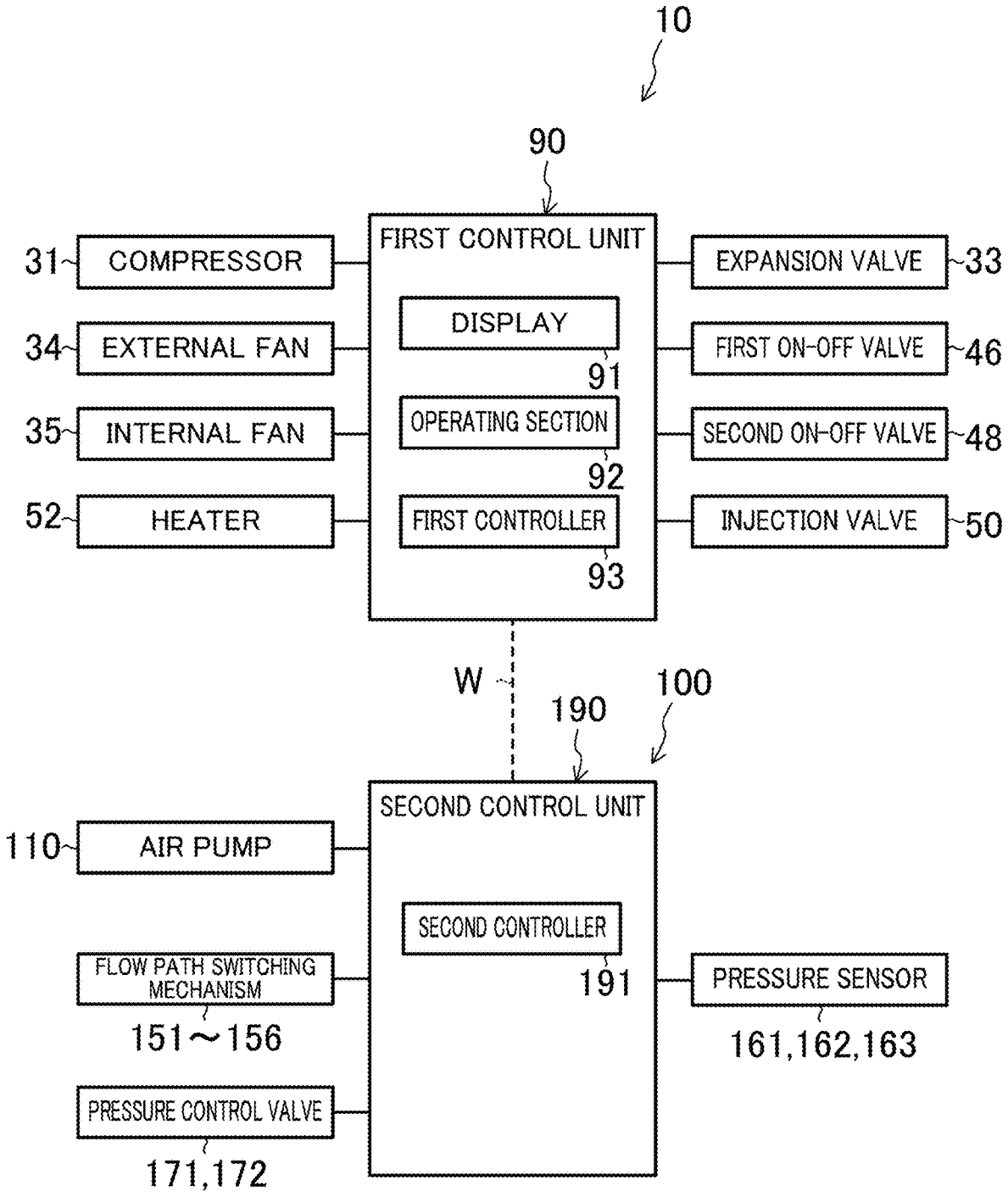
FIG. 4 is a block diagram illustrating a schematic configuration of the transport container of the first embodiment.

As illustrated in FIG. 4, the refrigeration apparatus (10) for transport includes a first control unit (90). The first control unit (90) includes a display (91), an operating section (92), and a first controller (93).

The display (91) includes a liquid crystal panel, for example. The display (91) displays information on operation of the refrigeration apparatus (10) for transport and the air control system (100).

The operator (92) includes an operation button. The operator (92) may be a touch panel to be used also as the liquid crystal panel serving as the display (91). A person uses the operator (92) to handle operation of the refrigeration apparatus (10) for transport. The person uses the operator (92) to set an operation condition for the refrigeration apparatus (10) for transport.

The first controller (93) includes a micro controller unit (MCU), an electric circuit, and an electronic circuit. The MCU includes a central processing unit (CPU), a memory, and a communication interface. The memory stores various programs to be executed by the CPU.

The first controller (93) controls the external fan (34), the internal fan (35), the heater (52), and the refrigerant circuit (30). Specifically, the first controller (93) controls the external fan (34), the internal fans (35), the heater (52), and the compressor (31). The first controller (93) controls the rotational speed of the external fan (34), the rotational speed of the internal fan (35), and the rotational speed (operation frequency) of the compressor (31). The first controller (93) controls the opening degrees of the expansion valve (33), the first on-off valve (46), the second on-off valve (48), and the injection valve (50).

(3-8) Operation of Refrigeration Apparatus for Transport

Basic operation of the refrigeration apparatus (10) for transport will be described below. When the refrigeration apparatus (10) for transport is in operation, the first controller (93) causes the compressor (31), the external fan (34), and the internal fans (35) to operate. The first controller (93) opens the first on-off valve (46) and closes the second on-off valve (48). The first controller (93) adjusts the opening degree of the expansion valve (33). The first controller (93) adjusts the opening degree of the injection valve (50).

The refrigerant compressed by the compressor (31) flows through the external heat exchanger (32). The refrigerant in the external heat exchanger (32) dissipates heat to outside air to condense. The condensed refrigerant passes through the receiver (44). Part of the refrigerant having passed through the receiver (44) flows through the first flow path (45*a*) of the cooling heat exchanger (45). The remaining refrigerant having passed through the receiver (44) flows through the injection pipe (49), and is decompressed to the intermediate pressure by the injection valve (50). The decompressed refrigerant is introduced into the intermediate-pressure portion of the compressor (31).

In the cooling heat exchanger (45), the refrigerant in the second flow path (45*b*) absorbs heat from the refrigerant in the first flow path (45*a*) to evaporate. This cools the refrigerant in the first flow path (45*a*). In other words, the degree of subcooling of the refrigerant flowing through the first flow path (45*a*) increases.

The refrigerant cooled in the cooling heat exchanger (45) is decompressed to a low pressure by the expansion valve (33). The decompressed refrigerant flows through the internal heat exchanger (51). The refrigerant in the internal heat exchanger (51) absorbs heat from inside air to evaporate. As a result, the internal heat exchanger (51) cools the inside air. The evaporated refrigerant is sucked into the compressor (31) and compressed again.

The inside air in the container body (2) circulates between the storage space (5) and the internal flow path (20). The internal heat exchanger (51) cools the inside air in the internal flow path (20). Thus, the inside air in the storage space (5) can be cooled and adjusted to a predetermined temperature.

(4) Air Control System

The refrigeration apparatus (10) for transport according to this embodiment includes the air control system (100).

The air control system (100) is provided for the refrigeration apparatus (10) for transport to provide so-called controlled atmosphere (CA) transport. The air control system (100) adjusts the composition of air in the storage space (5) of the transport container (1) such that the composition of the air is different from that of atmospheric air.

As illustrated in FIG. 5, the air control system (100) includes an air flow path (A) into which target air is introduced. The target air includes outside air and inside air. The air flow path (A) may be rigid pipes, may be flexible hoses, or may be combination of a pipe and a hose.

The air flow path (A) is provided with an air pump (110), a gas separation module (120), and a sensor unit (140). The air pump (110) transfers air in the air flow path (A). The gas separation module (120) adjusts the composition of air. The gas separation module (120) separates the target air into first air and second air. The sensor unit (140) measures the composition of air.

(4-1) Air Flow Path

The air flow path (A) includes an inflow path (101), a supply air flow path (102), an exhaust flow path (103), an internal exhaust path (104), a bypass flow path (105), and a sensor flow path (106).

The inflow path (101) is a flow path through which the target air is sent to the gas separation module (120). The inflow path (101) includes a first inflow path (101*a*), a second inflow path (101*b*), and an inflow trunk path (101*c*).

The first inflow path (101*a*) is a flow path through which outside air is introduced into the air flow path (A). The first inflow path (101*a*) has an inlet end opening to the external space (6). The first inflow path (101*a*) is provided with a first air filter (F1). The first air filter (F1) captures dust, salt, and other substances contained in outside air. The first air filter (F1) is configured as a membrane filter, for example.

The second inflow path (101*b*) is a flow path through which inside air is introduced into the air flow path (A). The second inflow path (101*b*) has an inlet end opening to the storage space (5). The second inflow path (101*b*) is provided with a second air filter (F2). The second air filter (F2) captures dust and other substances contained in inside air. The second air filter (F2) is configured as a membrane filter, for example. The second inflow path (101*b*) is provided with a first water separator (111).

The inflow trunk path (101*c*) has an inlet end connected to an outlet end of the first inflow path (101*a*) and an outlet end of the second inflow path (101*b*). The inflow trunk path (101*c*) has an outlet end connected to a first inlet port (I1) of the gas separation module (120). The inflow trunk path (101*c*) is provided with the air pump (110), a condensation circuit (112), a second water separator (113), and a water separation module (130) from the upstream side toward the downstream side of the air flow.

The supply flow path (102) is a flow path through which air separated by the gas separation module (120) is to be sent into the storage space (5). The supply flow path (102) includes a first supply path (102*a*), a second supply path (102*b*), and a supply trunk path (102*c*).

The first supply air path (102*a*) is a flow path through which the first air separated by the gas separation module (120) is to be sent into the storage space (5). The first supply air path (102*a*) has an inlet end connected to a first outlet port (O1) of the gas separation module (120).

The second supply air path (102*b*) is a flow path through which the second air separated by the gas separation module (120) is sent into the storage space (5). The second supply air path (102*b*) has an inlet end connected to a second outlet port (O2) of the gas separation module (120).

The supply air trunk path (102*c*) has an inlet end connected to an outlet end of the first supply air path (102*a*) and an outlet end of the second supply air path (102*b*). The supply air trunk path (102*c*) has an outlet end opening to the storage space (5). Strictly speaking, the outlet end of the supply air trunk path (102*c*) opens to a portion of the internal flow path (20) of the refrigeration apparatus (10) for transport downstream of the internal fans (35).

The exhaust flow path (103) is a flow path through which the air separated by the gas separation module (120) is to be discharged to the external space (6). The air includes either or both of the first air and the second air. The exhaust flow path (103) includes a first exhaust path (103*a*), a second exhaust path (103*b*), and an exhaust trunk path (103*c*).

The first exhaust path (103*a*) is a flow path through which the first air is to be discharged to the external space (6). The first exhaust path (103*a*) has an inlet end connected to the first supply air path (102*a*). The second exhaust path (103*b*) is a flow path through which the second air is to be discharged to the external space (6). The second exhaust path (103*b*) has an inlet end connected to the second supply path (102*b*). The exhaust trunk path (103*c*) has an inlet end connected to an outlet end of the first exhaust path (103*a*) and an outlet end of the second exhaust path (103*b*). The exhaust trunk path (103*c*) has an outlet end opening to the external space (6).

The internal exhaust path (104) is a flow path through which air in the storage space (5) is to be discharged to the external space (6). The internal exhaust path (104) has an inlet end connected to an intermediate portion of the second inflow path (101*b*). Strictly speaking, the inlet end of the internal exhaust path (104) is connected to a first switching valve (151). The internal exhaust path (104) has an outlet end opening to the external space (6).

The bypass flow path (105) is connected to the inflow trunk path (101*c*) to allow air to bypass the gas separation module (120). The bypass flow path (105) has an inlet end connected to the inflow trunk path (101*c*). Strictly speaking, the inlet end of the bypass flow path (105) is connected to a second switching valve (152).

The bypass flow path (105) has an outlet end connected to the first supply path (102*a*).

The sensor flow path (106) is a flow path through which air is sent to the sensor unit (140). The sensor flow path (106) includes a first sensor path (106*a*) and a second sensor path (106*b*). The first sensor path (106*a*) has an inlet end connected to the first supply path (102*a*). The first sensor path (106*a*) has an outlet end connected to the sensor unit (140). The second sensor path (106*b*) has an inlet end connected to the sensor unit (140). The second sensor path (106*b*) has an outlet end opening to the storage space (5). Strictly speaking, the outlet end of the second sensor path (106*b*) opens to a portion of the internal flow path (20) of the refrigeration apparatus (10) for transport upstream of the internal fans (35).

(4-2) Air Pump

The air pump (110) is an example of an air transferrer. The air pump (110) has a suction port and a discharge port. The air pump (110) compresses the air sucked in from the suction port, and discharges the compressed air from the discharge port.

(4-3-1) Configuration of Gas Separation Module

The gas separation module (120) separates the target air into the first air and the second air with different compositions. The gas separation module (120) is a composition adjuster.

Figure 6:
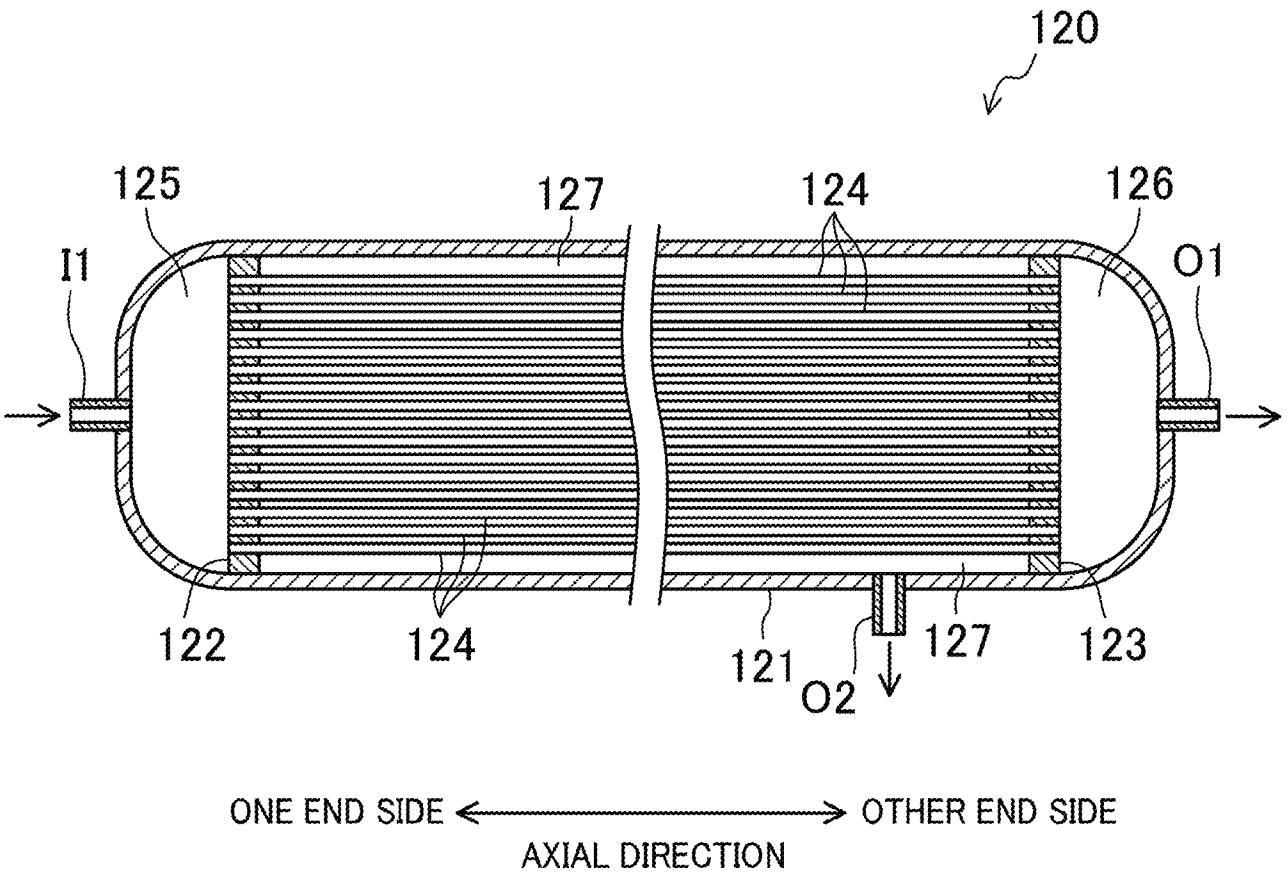
FIG. 6 is a schematic sectional view of a gas separation module provided in the air control system of the first embodiment.

As illustrated in FIG. 6, the gas separation module (120) has a first case (121), a first division wall (122), a second division wall (123), and a plurality of gas separation membranes (124). The first division wall (122) and the second division wall (123) are arranged inside the first case (121). The plurality of gas separation membranes (124) are arranged between the first division wall (122) and the second division wall (123).

The first case (121) is a cylindrical container with both ends closed. The first case (121) extends in its axial direction. The first case (121) has one axial end connected to the first inlet port (I1). The first case (121) has the other axial end connected to the first outlet port (O1). The first case (121) has a peripheral wall portion connected to the second outlet port (O2).

The first division wall (122) is arranged near one end of the first case (121). The second division wall (123) is arranged near the other end of the first case (121). The first division wall (122) and the second division wall (123) are partitioning members for axially partitioning the internal space of the first case (121). The first division wall (122) and the second division wall (123) are provided to cross the first case (121).

The first case (121) has therein a first introduction chamber (125), a first exhaust chamber (126), and a second exhaust chamber (127). The first introduction chamber (125) is formed between the one end of the first case (121) and the first division wall (122). The first exhaust chamber (126) is formed between the other end of the first case (121) and the second division wall (123). The second exhaust chamber (127) is formed in a space surrounded by the peripheral wall portion of the first case (121), the first division wall (122), and the second division wall (123) and located outside the plurality of gas separation membranes (124).

The gas separation membranes (124) are configured as hollow fiber membranes made of resin. In other words, the gas separation membranes (124) are formed in the shape of hollow fibers or elongated tubes. Each gas separation membrane (124) has an outer diameter of 1 mm or less. The gas separation membranes (124) have substantially the same thickness.

Each gas separation membrane (124) extends from the first division wall (122) to the second division wall (123) in the axial direction of the first case (121). One end (inlet end) of each gas separation membrane (124) passes through the first division wall (122) to open to the first introduction chamber (125). The other end (outlet end) of each gas separation membrane (124) passes through the second division wall (123) to open to the first exhaust chamber (126). The first introduction chamber (125) and the first exhaust chamber (126) communicate with each other through the gas separation membranes (124). The second exhaust chamber (127) does not substantially communicate with the first introduction chamber (125), the first exhaust chamber (126), and the interiors of the gas separation membranes (124).

The gas separation membranes (124) are non-porous membranes made of polymer. Using the fact that the rate at which molecules permeate through the gas separation membranes (124) varies among substances, the gas separation membranes (124) separate components contained in mixed gas from one another. The gas separation membrane (124) is a second separation membrane.

The permeation rate of nitrogen through the gas separation membranes (124) is lower than the permeation rates of both oxygen and carbon dioxide. In other words, the permeability of nitrogen through the gas separation membranes (124) is lower than the permeabilities of both oxygen and carbon dioxide.

(4-3-2) Action of Gas Separation Module

The target air in the inflow path (101) flows through the first inlet port (I1) into the first introduction chamber (125). The air in the first introduction chamber (125) flows through the inside of the gas separation membranes (124) toward the first exhaust chamber (126). Part of the air inside the gas separation membranes (124) permeates through the gas separation membranes (124) to move to the second exhaust chamber (127), and the remaining part thereof flows out into the first exhaust chamber (126).

The permeability of nitrogen through the gas separation membranes (124) is lower than the permeabilities of oxygen and carbon dioxide. In other words, nitrogen in the air is less likely to permeate through the gas separation membranes (124) than oxygen and carbon dioxide. Thus, as the air flowing through the inside of the gas separation membranes (124) approaches the first exhaust chamber (126), the nitrogen concentration of the air increases, and the oxygen concentration and carbon dioxide concentration thereof decrease. Oxygen and carbon dioxide contained in the air flowing through the gas separation membranes (124) permeate through the gas separation membranes (124) to move to the second exhaust chamber (127).

The nitrogen concentration in the air that has flowed out into the first exhaust chamber (126) is higher than the nitrogen concentration in the air in the first introduction chamber (125). The oxygen concentration and carbon dioxide concentration in the air having flowed out into the first exhaust chamber (126) are respectively lower than the oxygen concentration and carbon dioxide concentration in the air in the first introduction chamber (125). The air in the first exhaust chamber (126) is the first air. The first air flows out through the first outlet port (O1) into the first supply path (102*a*). The first air has a higher nitrogen concentration, a lower oxygen concentration, and a lower carbon dioxide concentration than those of the target air flowing into the gas separation module (120).

The nitrogen concentration in the air that has flowed out into the second exhaust chamber (127) is lower than the nitrogen concentration in the air in the first introduction chamber (125). The oxygen concentration and carbon dioxide concentration in the air having flowed out into the second exhaust chamber (127) are respectively higher than the oxygen concentration and carbon dioxide concentration in the air in the first introduction chamber (125). The air in the second exhaust chamber (127) is the second air. The second air flows out through the second outlet port (O2) into the second supply air path (102*b*). The second air has a lower nitrogen concentration, a higher oxygen concentration, and a higher carbon dioxide concentration than those of the target air flowing into the gas separation module (120).

(4-4) First Water Separator, Condensation Circuit, and Second Water Separator

The first water separator (111) is provided downstream of the second air filter (F2) in the second inflow path (101*b*). The first water separator (111) removes water contained in a liquid state in the air. Strictly speaking, the first water separator (111) is a cyclone gas-liquid separator that removes the water in the liquid state contained in the air by centrifugal force.

The condensation circuit (112) is arranged between the air pump (110) and the second water separator (113) in the inflow trunk path (101*c*). The condensation circuit (112) is configured as a heat transfer tube arranged in the storage space (5). The air flowing through the condensation circuit (112) is cooled by inside air. As a result, moisture in the air in the condensation circuit (112) condenses to form condensed water.

The second water separator (113) is arranged between the condensation circuit (112) and the water separation module (130) in the inflow trunk path (101*c*). The second water separator (113) removes moisture contained in air. Strictly speaking, the second water separator (113) is a cyclone gas-liquid separator configured to remove water in the liquid state contained in the air by centrifugal force.

(4-5-1) Configuration of Water Separation Module

The water separation module (130) is arranged upstream of the gas separation module (120) in the inflow trunk path (101*c*). The water separation module (130) is a dehumidifying unit configured to remove water vapor from the target air. Strictly speaking, the water separation module (130) separates water molecules contained in air. The water separation module (130) of this example is a membrane dryer, which is the SUNSEP (the registered trademark).

Figure 7:
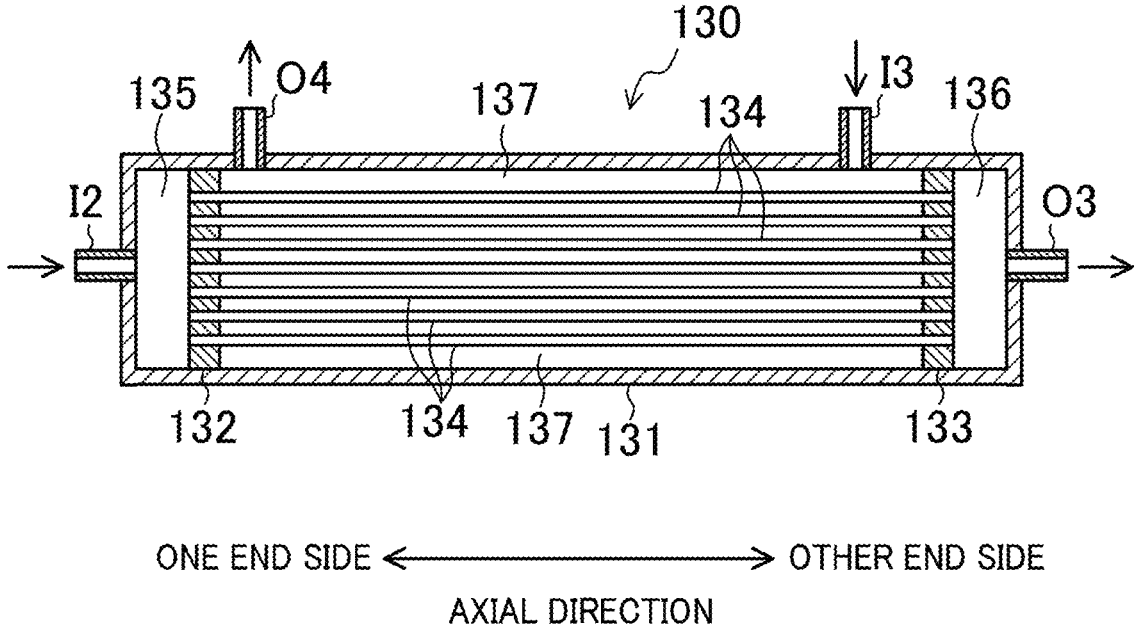
FIG. 7 is a schematic sectional view of a water separation module provided in the air control system of the first embodiment.

As illustrated in FIG. 7, the water separation module (130) includes a second case (131), a third division wall (132), a fourth division wall (133), and a plurality of water separation membranes (134). The third division wall (132) and the fourth division wall (133) are arranged inside the second case (131). The plurality of water separation membranes (134) is arranged between the third division wall (132) and the fourth division wall (133).

The second case (131) is a cylindrical container with both ends closed. The second case (131) extends in its axial direction. The second case (131) has one axial end connected to a second inlet port (I2). The second case (131) has the other axial end connected to a third outlet port (O3). The second case (131) has a peripheral wall portion connected to a third inlet port (13) and a fourth outlet port (O4). The third inlet port (I3) is located in a portion of the peripheral wall portion of the second case (131) near the other end of the second case (131). The fourth outlet port (O4) is located in a portion of the peripheral wall portion of the second case (131) near the one end of the second case (131).

As illustrated in FIG. 5, the second inlet port (I2) is connected to a flow path of the inflow trunk path (101*c*) upstream of the water separation module (130). The third outlet port (O3) is connected to a flow path of the inflow trunk path (101*c*) upstream of the gas separation module (120).

The air flow path (A) includes an introduction path (107) and a water supply path (108). The introduction path (107) and the water supply path (108) are connected to the water separation module (130).

The introduction path (107) is a flow path through which air with relatively low humidity is to be supplied to the water separation module (130). The introduction path (107) has an inlet end connected to the supply trunk path (102*c*). The introduction path (107) has an outlet end connected to the third inlet port (I3) of the water separation module (130).

The water supply path (108) is a flow path through which water separated by the water separation module (130) is to be sent into the storage space (5). The water supply path (108) has an inlet end connected to the fourth outlet port (O4) of the water separation module (130). The water supply path (108) has an outlet end connected to a portion of the supply air trunk path (102*c*) downstream of the inlet end of the introduction path (107). Strictly speaking, the outlet end of the water supply path (108) is connected downstream of a fifth switching valve (155) in the supply air trunk path (102*c*).

The second case (131) has therein a second introduction chamber (135), a third exhaust chamber (136), and a fourth exhaust chamber (137). The second introduction chamber (135) is formed between the one end of the second case (131) and the third division wall (132). The third exhaust chamber (136) is formed between the other end of the second case (131) and the fourth division wall (133). The fourth exhaust chamber (137) is formed in a space surrounded by the peripheral wall portion of the second case (131), the third division wall (132), and the fourth division wall (133) and located outside the plurality of water separation membranes (134).

The water separation membranes (134) extend from the third division wall (132) to the fourth division wall (133) in the axial direction of the second case (131). One end (inlet end) of each water separation membrane (134) passes through the third division wall (132) to open to the second introduction chamber (135). The other end (outlet end) of each water separation membrane (134) passes through the fourth division wall (133) to open to the third exhaust chamber (136). The second introduction chamber (135) and the third exhaust chamber (136) communicate with each other through the water separation membranes (134). The fourth exhaust chamber (137) does not substantially communicate with the second introduction chamber (135), the third exhaust chamber (136), and the interiors of the water separation membranes (134).

The water separation membranes (134) are configured as hollow fiber membranes made of resin. In other words, the water separation membranes (134) are formed in the shape of hollow fibers or elongated tubes. The water separation membranes (134) are made of fluorine-based ion-exchange resin. The water separation membranes (134) have a property of allowing water molecules in air to permeate therethrough. The water separation membranes (134) are first separation membranes allowing water vapor to permeate therethrough.

(4-5-2) Action of Water Separation Module

The target air in the inflow path (101) flows through the second inlet port (I2) into the second introduction chamber (135). The air in the second introduction chamber (135) flows through the interiors of the water separation membranes (134) toward the third exhaust chamber (136). The air in the supply air trunk path (102*c*) flows through the third inlet port (I3) into the fourth exhaust chamber (137).

In the water separation module (130), the absolute humidity of the target air flowing into the second inlet port (I2) is higher than the absolute humidity of air flowing into the third inlet port (I3). Thus, in the water separation module (130), water molecules in the air inside the water separation membranes (134) permeate through the water separation membranes (134) to move to the fourth exhaust chamber (137). The water molecules having permeated through the water separation membranes (134) are applied to air flowing through the fourth exhaust chamber (137). The air inside the water separation membranes (134) is dehumidified by losing the water molecules, and flows out into the third exhaust chamber (136). The air in the third exhaust chamber (136) flows out into the inflow trunk path (101*c*) through the third outlet port (O3), and is supplied to the gas separation module (120).

The air humidified in the fourth exhaust chamber (137) flows out into the water supply path (108) through the fourth outlet port (O4). The air in the water supply path (108) flows out into the supply air trunk path (102*c*), and is sent into the storage space (5).

(4-6) Sensor Unit

The sensor unit (140) includes an oxygen sensor (141), a carbon dioxide sensor (142), and a sensor case (143).

The oxygen sensor (141) is a sensor of zirconia current type that measures the oxygen concentration of mixed gas such as air. The carbon dioxide sensor (142) is a non-dispersive infrared (NDIR) sensor configured to measure the carbon dioxide concentration of mixed gas such as air. The oxygen sensor (141) and the carbon dioxide sensor (142) are housed in the sensor case (143).

The sensor case (143) is a box-shaped member. The sensor case (143) includes a third air filter (F3). The third air filter (F3) is a membrane filter for capturing dust and other substances contained in inside air. The third air filter (F3) filters the inside air flowing into the sensor case (143).

(4-7) Flow Path Switching Mechanism

The air flow path (A) is provided with a flow path switching mechanism for changing the air flow. The flow path switching mechanism includes the first switching valve (151), the second switching valve (152), a third switching valve (153), a fourth switching valve (154), and the fifth switching valve (155). These switching valves (151, 152, 153, 154, 155) are configured as three-way valves.

The first switching valve (151) is provided at the joint between the second inflow path (101*b*) and the internal exhaust path (104). The first switching valve (151) switches between a first state in which inside air is supplied to the gas separation module (120) and a second state in which inside air is discharged into the external space (6). Specifically, the first switching valve (151) in the first state allows the storage space (5) and the inflow trunk path (101*c*) to communicate with each other, and allows the storage space (5) and the external space (6) to be isolated from each other. The first switching valve (151) in the second state allows the storage space (5) and the inflow trunk path (101*c*) to be isolated from each other, and allows the storage space (5) and the external space (6) to communicate with each other.

The second switching valve (152) is provided at the joint between the inflow trunk path (101*c*) and the bypass flow path (105). In other words, the second switching valve (152) is provided upstream of the gas separation membranes (124) in the inflow trunk path (101*c*). The second switching valve (152) switches between a first state in which air in the inflow path (101) is supplied to the gas separation module (120) and a second state in which the air in the inflow path (101) bypasses the gas separation module (120). Specifically, the second switching valve (152) in the first state allows the inflow trunk path (101*c*) and the gas separation module (120) to communicate with each other, and allows the inflow trunk path (101*c*) and the bypass flow path (105) to be isolated from each other. The second switching valve (152) in the second state allows the inflow trunk path (101*c*) and the gas separation module (120) to be isolated from each other, and allows the inflow trunk path (101*c*) and the bypass flow path (105) to communicate with each other.

The third switching valve (153) is provided at the joint between the first supply air path (102*a*) and the first exhaust path (103*a*). In other words, the third switching valve (153) is provided between the junction of the first supply path (102*a*) with the sensor flow path (106) and the outlet end of the first supply path (102*a*). The third switching valve (153) switches between a first state in which air in the first supply path (102*a*) is supplied into the storage space (5) and a second state in which the air in the first supply path (102*a*) is discharged to the external space (6). Specifically, the third switching valve (153) in the first state allows the first supply path (102*a*) and the storage space (5) to communicate with each other, and allows the first supply path (102*a*) and the first exhaust path (103*a*) to be isolated from each other. The third switching valve (153) in the second state allows the first supply path (102*a*) and the storage space (5) to be isolated from each other, and allows the first supply path (102*a*) and the first exhaust path (103*a*) to communicate with each other.

The fourth switching valve (154) is provided at the joint between the second supply air path (102*b*) and the second exhaust path (103*b*). In other words, the fourth switching valve (154) is provided between the second outlet port (O2) of the gas separation module (120) and the outlet end of the second supply path (102*b*) in the second supply path (102*b*). The fourth switching valve (154) switches between a first state in which air in the second supply path (102*b*) is supplied into the storage space (5) and a second state in which the air in the second supply path (102*b*) is discharged to the external space (6). Specifically, the fourth switching valve (154) in the first state allows the second supply path (102*b*) and the storage space (5) to communicate with each other, and allows the second supply path (102*b*) and the second exhaust path (103*b*) to be isolated from each other. Specifically, the fourth switching valve (154) in the second state allows the second supply path (102*b*) and the storage space (5) to be isolated from each other, and allows the second supply path (102*b*) and the second exhaust path (103*b*) to communicate with each other.

The fifth switching valve (155) is provided at the joint between the supply air trunk path (102*c*) and the introduction path (107). In other words, the fifth switching valve (155) is provided upstream of the water supply path (108) in the supply trunk path (102*c*). The fifth switching valve (155) switches between a first state in which air in the supply flow path (102) is supplied into the storage space (5) without passing through the water separation module (130) and a second state in which the air in the supply flow path (102) is supplied into the storage space (5) via the water separation module (130). Specifically, the fifth switching valve (155) in the first state allows the supply trunk path (102*c*) and the introduction path (107) to communicate with each other, and allows the supply trunk path (102*c*) and the storage space (5) to be isolated from each other. The fifth switching valve (155) in the second state allows the supply air trunk path (102*c*) and the introduction path (107) to be isolated from each other, and allows the supply air trunk path (102*c*) and the storage space (5) to communicate with each other.

The flow path switching mechanism includes an air on-off valve (156) provided in the air flow path (A). The air on-off valve (156) is provided in the first sensor path (106*a*). The air on-off valve (156) is configured as an electromagnetic valve, for example, and opens and closes the sensor flow path (106).

(4-8) Check Valve

The air flow path (A) is provided with a first check valve (157) and a second check valve (158).

The first check valve (157) is provided in the first supply path (102*a*). Specifically, the first check valve (157) is provided between the first outlet port (O1) of the gas separation module (120) and the junction of the first supply path (102*a*) with the bypass flow path (105) in the first supply path (102*a*). The first check valve (157) allows the air to flow from the first outlet port (O1) of the gas separation module (120) toward the outlet end of the first supply air path (102*a*) and prevents the air from flowing in the reverse direction.

The second check valve (158) is provided in the second supply path (102*b*). Specifically, the second check valve (158) is provided between the second outlet port (O2) of the gas separation module (120) and the junction of the second supply path (102*b*) with the second exhaust path (103*b*) in the second supply path (102*b*). The second check valve (158) allows the air to flow from the second outlet port (O2) of the gas separation module (120) toward the outlet end of the second supply air path (102*b*) and prevents the air from flowing in the reverse direction.

(4-9) Pressure Sensor

The air flow path (A) is provided with a first pressure sensor (161), a second pressure sensor (162), and a third pressure sensor (163). These pressure sensors (161, 162, 163) detect the pressure of air.

The first pressure sensor (161) is provided downstream of the water separation module (130) in the inflow path (101). Specifically, the first pressure sensor (161) is provided between the first outlet port (O1) of the water separation module (130) and the second switching valve (152) in the inflow trunk path (101*c*). The first pressure sensor (161) detects the internal pressure of the water separation module (130). Specifically, the first pressure sensor (161) detects the internal pressure of the third exhaust chamber (136) or water separation membranes (134) of the water separation module (130).

The second pressure sensor (162) is provided downstream of the gas separation module (120) in the first supply path (102*a*). Specifically, the second pressure sensor (162) is provided between the first outlet port (O1) of the gas separation module (120) and the third switching valve (153) in the first supply path (102*a*). The second pressure sensor (162) detects the internal pressure of the gas separation module (120). Specifically, the second pressure sensor (162) detects the pressure of the first exhaust chamber (126) of the gas separation module (120) or the internal pressure of the gas separation membranes (124) of the gas separation module (120).

The third pressure sensor (163) is provided downstream of the gas separation module (120) in the second supply path (102*b*). Specifically, the third pressure sensor (163) is provided between the second outlet port (O2) of the gas separation module (120) and the fourth switching valve (154) in the second supply air path (102*b*). The third pressure sensor (163) detects the pressure of the second exhaust chamber (127) of the gas separation module (120).

(4-10) Pressure Control Valve

The air flow path (A) is provided with a first pressure control valve (171) and a second pressure control valve (172). Each of the first pressure control valve (171) and the second pressure control valve (172) is an electric valve having a variable opening degree.

The first pressure control valve (171) is provided downstream of the water separation module (130) in the inflow path (101). Specifically, the first pressure control valve (171) is provided between the first pressure sensor (161) and the second switching valve (152) in the inflow trunk path (101*c*). The first pressure control valve (171) is a first throttle mechanism exhibiting throttling expansion action.

The first pressure control valve (171) is a first pressure control mechanism configured to control the pressure of the target air flowing through the water separation module (130). When the opening degree of the first pressure control valve (171) is changed, the internal pressure of the water separation module (130) changes. Specifically, when the opening degree of the first pressure control valve (171) is changed, the pressure of the third exhaust chamber (136) of the water separation module (130) and the internal pressure of the water separation membranes (134) change.

The second pressure control valve (172) is provided downstream of the gas separation module (120) in the first supply path (102*a*). Specifically, the second pressure control valve (172) is provided between the second pressure sensor (162) and the third switching valve (153) in the first supply path (102*a*). The second pressure control valve (172) is a second throttle mechanism exhibiting exhibits throttling expansion action.

The second pressure control valve (172) is a second pressure control mechanism configured to control the pressure of air on the primary side of the gas separation membranes (124) in the gas separation module (120) (specifically, air flowing through a portion of the internal space of the gas separation module (120) communicating with the first inlet port (I1)). When the opening degree of the second pressure control valve (172) is changed, the internal pressure of the gas separation module (120) changes. Specifically, when the opening degree of the second pressure control valve (172) is changed, the pressure of the first exhaust chamber (126) of the gas separation module (120) and the internal pressure of the gas separation membranes (124) change.

Here, the throttling expansion action is action of decompressing fluid by passing the fluid through a narrow passage. The first pressure control valve (171) as the first throttle mechanism decompresses the target air having passed through the water separation module (130). The second pressure control valve (172) as the second throttle mechanism decompresses the first air having flowed out of the gas separation module (120).

(4-11) Second Control Unit

As illustrated in FIGS. 4 and 5, the air control system (100) includes a second control unit (190). The second control unit (190) is connected to the first control unit (90) via a communication line (W). The communication line (W) transfers signals and information between the first control unit (90) and the second control unit (190). The communication line (W) is wired, but may be wireless.

The second control unit (190) includes a second controller (191).

The second controller (191) includes a micro control unit (MCU), an electric circuit, and an electronic circuit. The MCU includes a central processing unit (CPU), a memory, and a communication interface. The memory stores various programs to be executed by the CPU.

The second controller (191) receives signals detected by the first pressure sensor (161), the second pressure sensor (162), and the third pressure sensor (163). The second controller (191) controls the air pump (110), the flow path switching mechanism, and the pressure control valves (171, 172). Specifically, the second controller (191) controls operation of the air pump (110). The second controller (191) switches each of the switching valves (151, 152, 153, 154, 155) between the first state and the second state. The second controller (191) opens and closes the air on-off valve (156). The second controller (191) adjusts the opening degrees of the pressure control valves (171, 172).

(4-12) Operation of Air Control System

The operation of the air control system (100) will be described. The operation of the air control system (100) includes first to fifth operations, which will be described below. In this example, in each of the first to fifth operations, the second controller (191) sets the fifth switching valve (155) in the first state. Thus, in each of these operations, the water separation module (130) performs an action of removing moisture in the air.

(4-12-1) First Operation

The first operation is an operation of supplying the first air into the storage space (5) and discharging the second air to the external space (6), where both outside air and inside air are taken as the target air. This first operation is performed to reduce the oxygen concentration of the air in the storage space (5).

Figure 8:
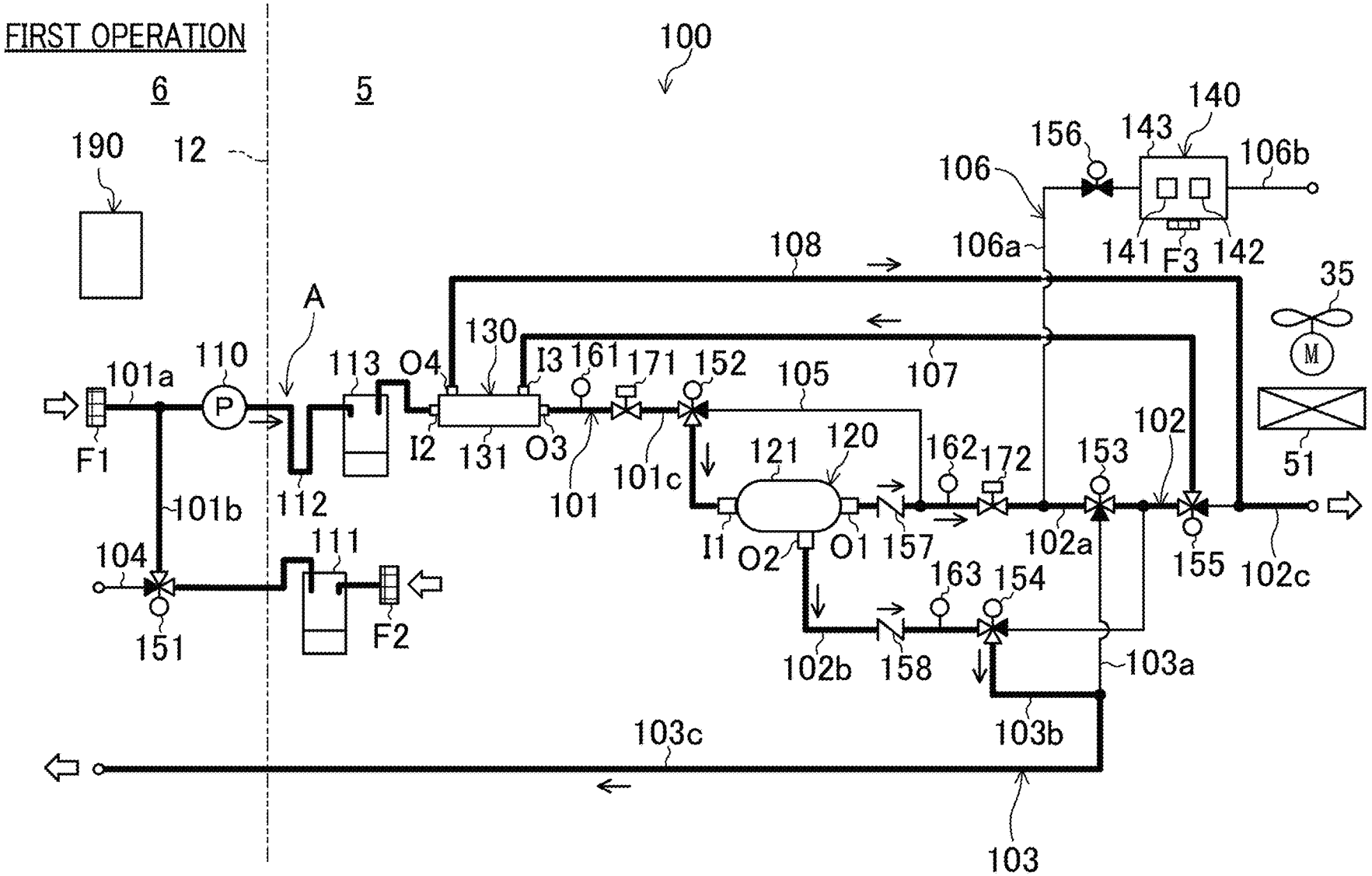
FIG. 8 is a diagram corresponding to FIG. 5 and illustrating a first operation of the air control system of the first embodiment.

As illustrated in FIG. 8, in the first operation, the second controller (191) sets the first switching valve (151) in the first state; sets the second switching valve (152) in the first state; sets the third switching valve (153) in the first state; sets the fourth switching valve (154) in the second state; sets the fifth switching valve (155) in the first state; and sets the air on-off valve (156) in the closed state.

In the first operation, inside air flowing through the second inflow path (101*b*) flows through the first water separator (111). The first water separator (111) separates water (liquid) in the inside air. The air having passed through the first water separator (111) and the outside air flowing through the first inflow path (101*a*) flow into the inflow trunk path (101*c*) so as to be mixed together. The resultant mixed air is then sucked into the air pump (110) as the target air. The air pump (110) compresses the sucked air and discharges the compressed air. The air discharged from the air pump (110) is cooled by the condensation circuit (112), and then flows through the second water separator (113). The second water separator (113) separates water condensed during the passage of the target air through the condensation circuit (112) from the target air.

The air having passed through the second water separator (113) is dehumidified by flowing through the water separation membranes (134) of the water separation module (130). The target air dehumidified in the water separation module (130) flows into the gas separation module (120). In the gas separation module (120), the target air is separated into the first air and the second air.

The first air having a lower oxygen concentration than that of the target air flows through the first supply path (102*a*) and the introduction path (107) in this order, and then flows through the fourth exhaust chamber (137) of the water separation module (130). In the fourth exhaust chamber (137), water molecules having permeated through the water separation membranes (134) are applied to the first air. The first air humidified in the water separation module (130) flows through the water supply path (108) and the supply trunk path (102*c*) in this order, and is then supplied into the storage space (5).

The second air having a higher oxygen concentration than that of the target air flows through the second supply path (102*b*), the second exhaust path (103*b*), and the exhaust trunk path (103*c*) in this order, and is then discharged to the external space (6).

In the first operation, the storage space (5) is maintained at a positive pressure. In other words, an air pressure in the storage space (5) becomes higher than an air pressure outside the transport container (1) (i.e., atmospheric pressure).

(4-12-2) Second Operation

The second operation is an operation of supplying the first air into the storage space (5) and discharging the second air to the external space (6), where the outside air is taken as the target air. This second operation is performed to reduce the oxygen concentration of the air in the storage space (5).

Figure 9:
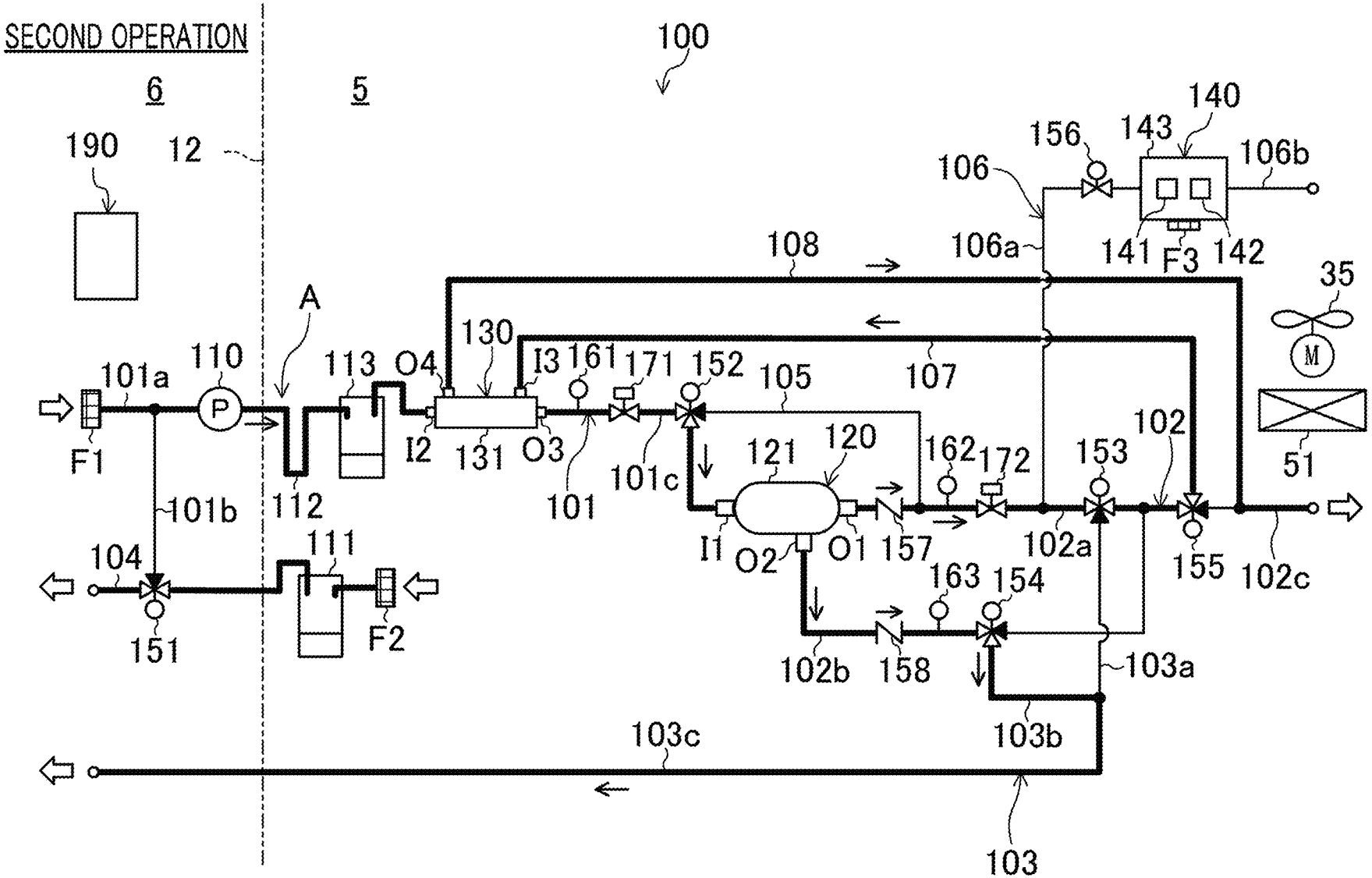
FIG. 9 is a diagram corresponding to FIG. 5 and illustrating a second operation of the air control system of the first embodiment.

As illustrated in FIG. 9, in the second operation, the second controller (191) sets the first switching valve (151) in the second state; sets the second switching valve (152) in the first state; sets the third switching valve (153) in the first state; sets the fourth switching valve (154) in the second state; sets the fifth switching valve (155) in the first state; and sets the air on-off valve (156) in the closed state.

The outside air flowing through the first inflow path (101*a*) is compressed by the air pump (110), and then passes through the condensation circuit (112) and the second water separator (113). The air having passed through the second water separator (113) is dehumidified by flowing through the water separation membranes (134) of the water separation module (130). The target air dehumidified in the water separation module (130) flows into the gas separation module (120). In the gas separation module (120), the target air is separated into the first air and the second air. The first air having a lower oxygen concentration than that of the target air and humidified in the water separation module (130) flows through the water supply path (108) and the supply trunk path (102*c*) in this order, and is then supplied into the storage space (5).

The second air having a higher oxygen concentration than that of the target air flows through the second supply path (102*b*), the second exhaust path (103*b*), and the exhaust trunk path (103*c*) in this order, and is then discharged to the external space (6).

In the second operation, the storage space (5) is maintained at a positive pressure. Thus, the air in the storage space (5) flows through the second inflow path (101*b*) and the internal exhaust path (104), and is discharged to the external space (6). As a result, the air in the storage space (5) is gradually replaced with the first air.

(4-12-3) Third Operation

The third operation is an operation of discharging the first air to the outside of the container and supplying the second air to the inside of the container, where both the outside air and the inside air are taken as the target air. This third operation is performed to increase the oxygen concentration of the air in the storage space (5).

Figure 10:
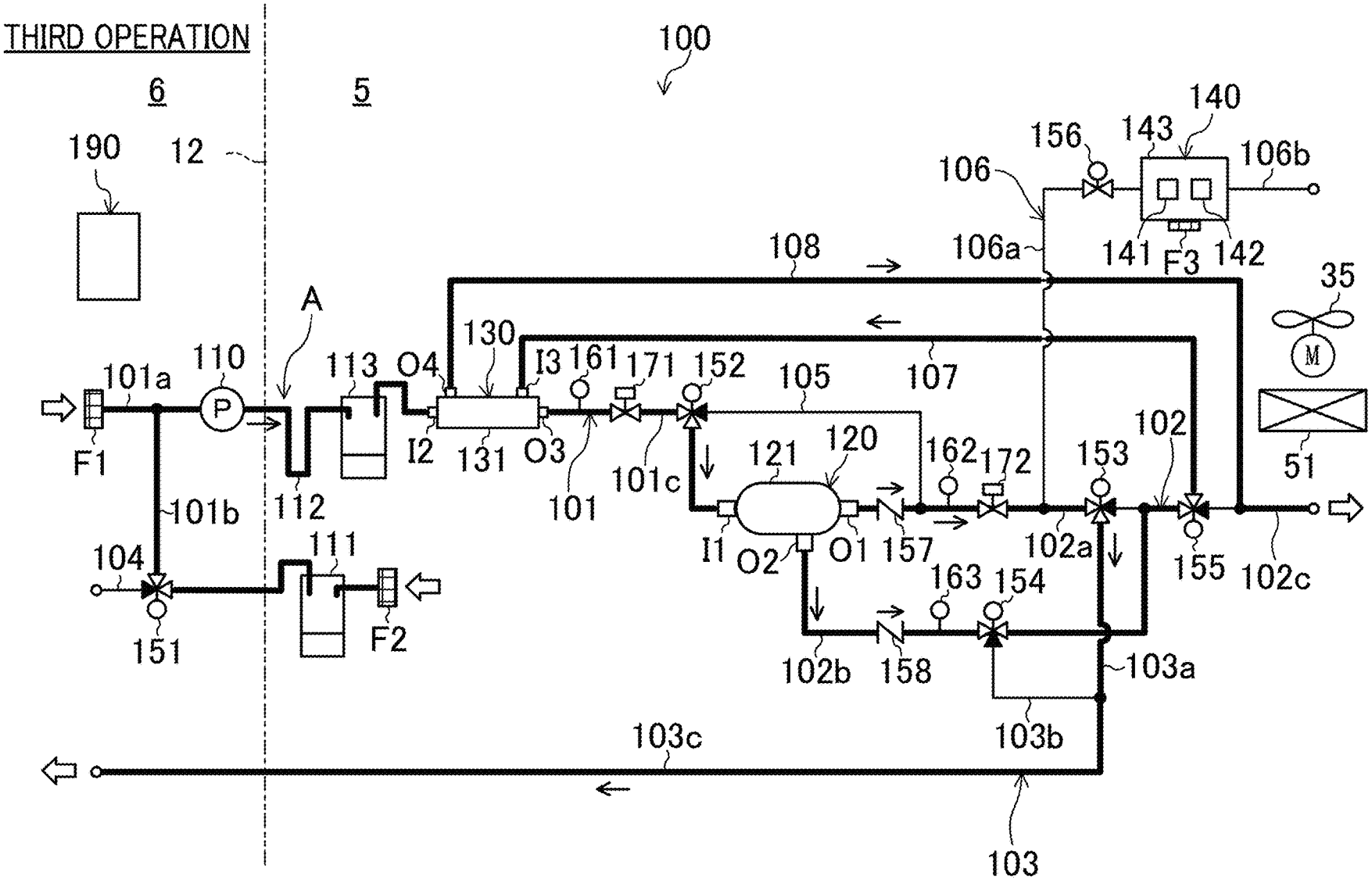
FIG. 10 is a diagram corresponding to FIG. 5 and illustrating a third operation of the air control system of the first embodiment.

As illustrated in FIG. 10, in the third operation, the second controller (191) sets the first switching valve (151) in the first state; sets the second switching valve (152) in the first state; sets the third switching valve (153) in the second state; sets the fourth switching valve (154) in the first state; sets the fifth switching valve (155) in the first state; and sets the air on-off valve (156) in the closed state.

In the third operation, a mixture (target air) of the outside air flowing through the first inflow path (101*a*) and the inside air flowing through the second inflow path (101*b*) is compressed by the air pump (110), and then passes through the condensation circuit (112) and the second water separator (113). The air having passed through the second water separator (113) is dehumidified by flowing through the water separation membranes (134) of the water separation module (130). The target air dehumidified in the water separation module (130) flows into the gas separation module (120). In the gas separation module (120), the target air is separated into the first air and the second air. The first air having a lower oxygen concentration than that of the target air flows through the first supply path (102*a*), the first exhaust path (103*a*), and the exhaust trunk path (103*c*) in this order, and is discharged to the external space (6).

The second air having a higher oxygen concentration than that of the target air flows through the second supply path (102*b*) and the introduction path (107) in this order, and then flows through the fourth exhaust chamber (137) of the water separation module (130). In the fourth exhaust chamber (137), water molecules having permeated through the water separation membranes (134) are applied to the second air. The second air humidified in the water separation module (130) flows through the water supply path (108) and the supply trunk path (102*c*) in this order, and is then supplied into the storage space (5).

In the third operation, the storage space (5) is maintained at a positive pressure.

(4-12-4) Fourth Operation

The fourth operation is an operation of discharging the first air to the outside of the container and supplying the second air to the inside of the container, where the outside air is taken as the target air. This fourth operation is performed to increase the oxygen concentration of the air in the storage space (5).

Figure 11:
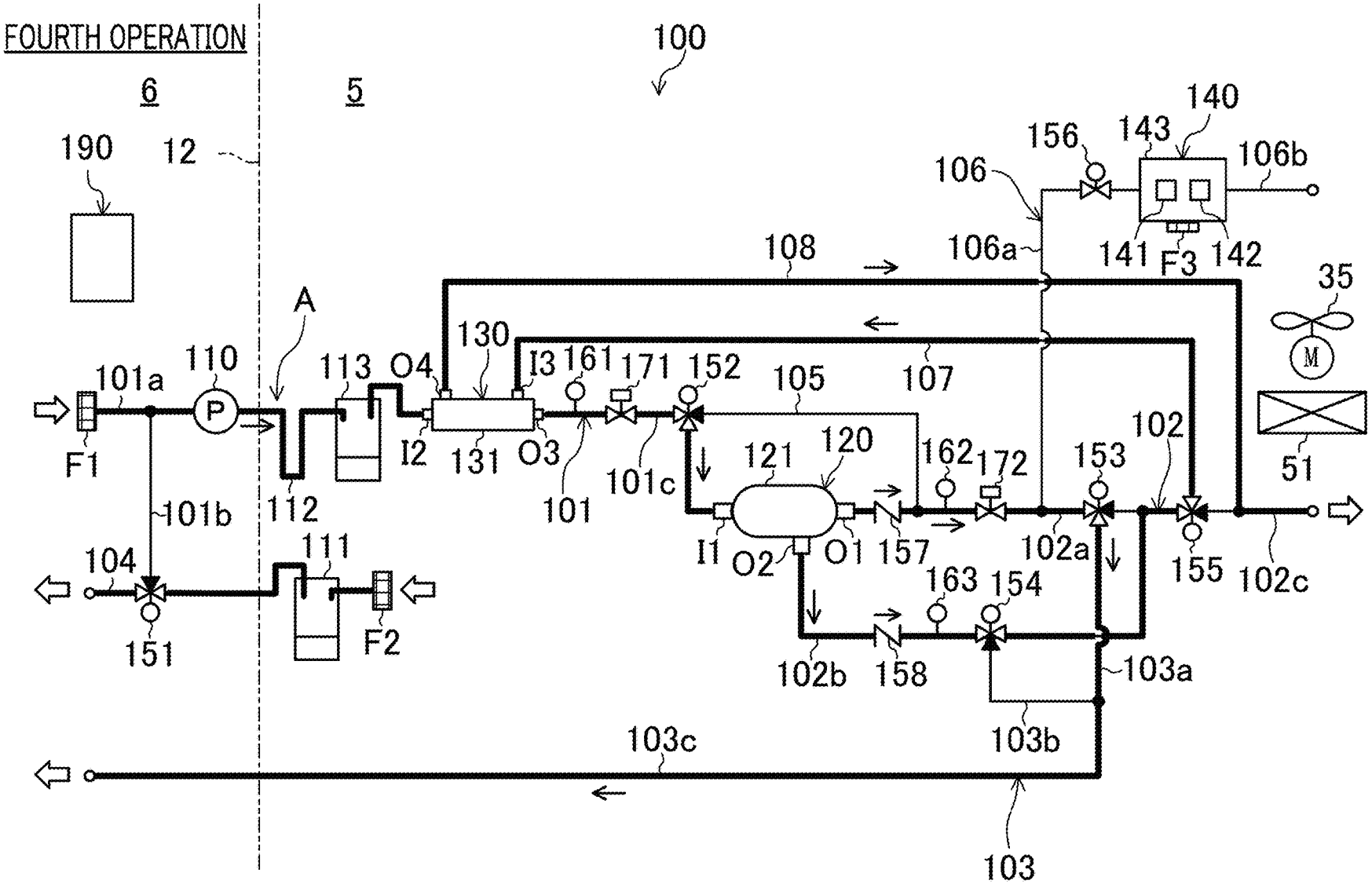
FIG. 11 is a diagram corresponding to FIG. 5 and illustrating a fourth operation of the air control system of the first embodiment.

As illustrated in FIG. 11, in the fourth operation, the second controller (191) sets the first switching valve (151) in the second state; sets the second switching valve (152) in the first state; sets the third switching valve (153) in the second state; sets the fourth switching valve (154) in the first state; sets the fifth switching valve (155) in the first state; and sets the air on-off valve (156) in the closed state.

The outside air (target air) flowing through the first inflow path (101*a*) is compressed by the air pump (110), and then passes through the condensation circuit (112) and the second water separator (113). The air having passed through the second water separator (113) is dehumidified by flowing through the water separation membranes (134) of the water separation module (130). The target air dehumidified in the water separation module (130) flows into the gas separation module (120). In the gas separation module (120), the target air is separated into the first air and the second air. The second air having a higher oxygen concentration than that of the target air and humidified in the water separation module (130) flows through the water supply path (108) and the supply trunk path (102*c*) in this order, and is then supplied into the storage space (5).

The first air having a lower oxygen concentration than that of the target air flows through the second supply path (102*b*), the second exhaust path (103*b*), and the exhaust trunk path (103*c*) in this order, and is discharged to the external space (6).

In the fourth operation, the storage space (5) is maintained at a positive pressure. Thus, the air in the storage space (5) flows through the second inflow path (101*b*) and the internal exhaust path (104), and is discharged to the external space (6). As a result, the air in the storage space (5) is gradually replaced with the second air.

(4-12-5) Fifth Operation

The fifth operation is an operation of supplying the outside air directly to the inside of the container. This fifth operation is performed to increase the oxygen concentration of the air in the storage space (5).

Figure 12:
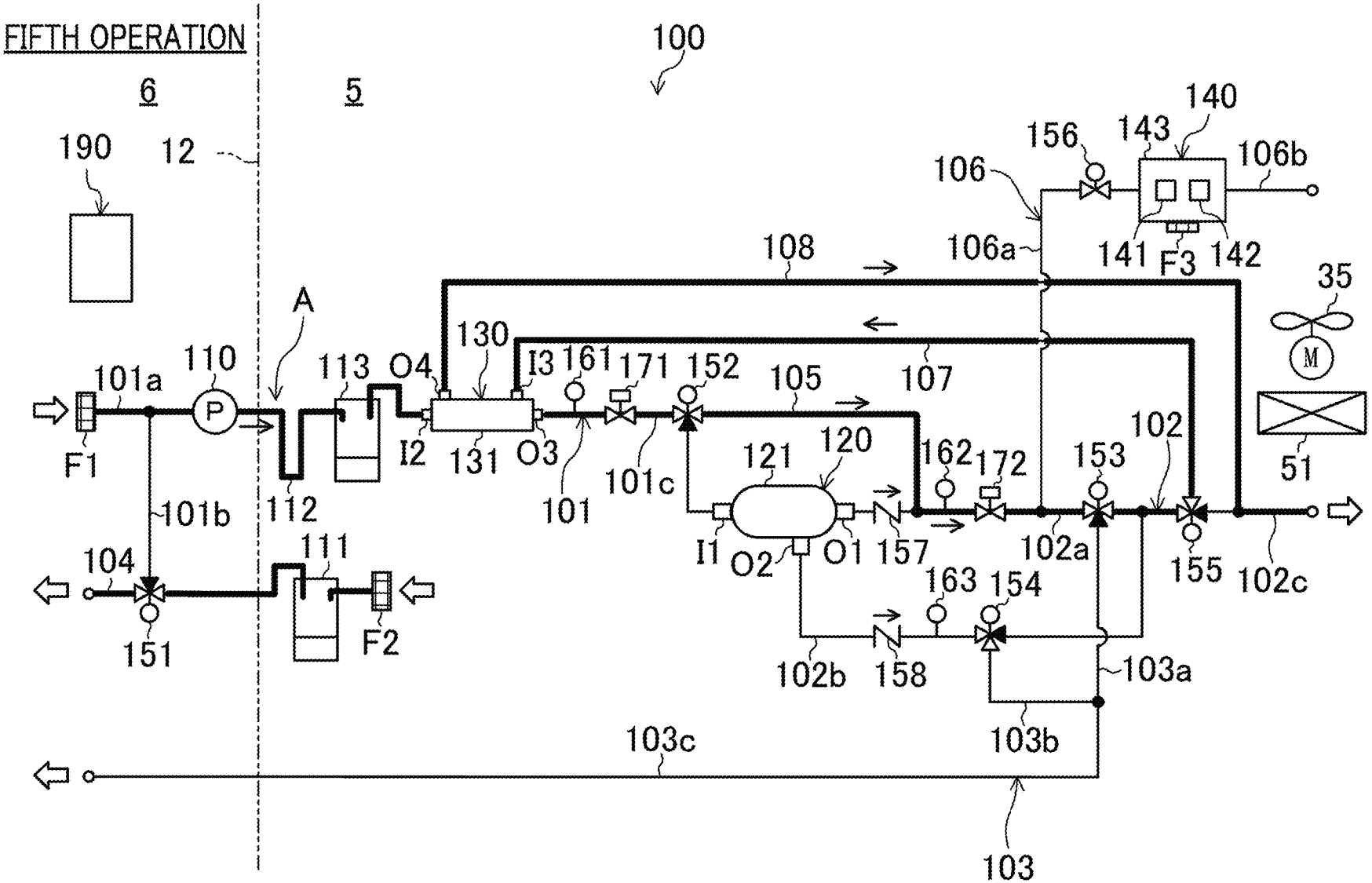
FIG. 12 is a diagram corresponding to FIG. 5 and illustrating a fifth operation of the air control system of the first embodiment.

As illustrated in FIG. 12, in the fifth operation, the second controller (191) sets the first switching valve (151) in the second state; sets the second switching valve (152) in the second state; sets the third switching valve (153) in the first state; sets the fourth switching valve (154) in the second state; sets the fifth switching valve (155) in the first state; and sets the air on-off valve (156) in the closed state.

The outside air flowing through the first inflow path (101*a*) is compressed by the air pump (110), and then passes through the condensation circuit (112) and the second water separator (113). The air having passed through the second water separator (113) is dehumidified by flowing through the water separation membranes (134) of the water separation module (130). The air dehumidified in the water separation module (130) flows through the bypass flow path (105) to bypass the gas separation module (120). The air having flowed out of the bypass flow path (105) flows through the first supply path (102*a*) and the introduction path (107) in this order, and then flows through the fourth exhaust chamber (137) of the water separation module (130). In the fourth exhaust chamber (137), water molecules having permeated through the water separation membranes (134) are applied to the air. The air humidified in the water separation module (130) flows through the water supply path (108) and the supply trunk path (102*c*) in this order, and is then supplied into the storage space (5).

In the fifth operation, the storage space (5) is maintained at a positive pressure. Thus, the air in the storage space (5) flows through the second inflow path (101*b*) and the internal exhaust path (104), and is discharged to the external space (6). As a result, the air in the storage space (5) is gradually replaced with the outside air.

(5) Features of First Embodiment (5-1)

In the air control system (100) of this embodiment, the water separation module (130) is arranged upstream of the gas separation module (120) in the air flow path (A). The target air directed to the gas separation module (120) is dehumidified while passing through the water separation module (130), and the relative humidity thereof becomes approximately 0%. Thus, the target having an extremely low humidity and having flowed out of the water separation module (130) flows into the gas separation module (120) having the gas separation membranes (124). Consequently, according to this embodiment, the humidity of the target air in contact with the gas separation membranes (124) of the gas separation module (120) can be kept low, and degradation of the performance of the gas separation membranes (124) due to water vapor can be reduced.

(5-2)

In the air control system (100) of this embodiment, the first pressure control valve (171) is provided downstream of the water separation module (130) in the air flow path (A). The first pressure control valve (171) decompresses the target air having passed through the water separation module (130). Thus, in the water separation module (130) located upstream of the first pressure control valve (171), the pressure of the target air passing through the tubular water separation membranes (134) is maintained at a certain level or higher. As a result, the amount of water molecules permeating through the water separation membranes (134) can be ensured, and the dehumidification performance of the water separation module (130) can be reliably exhibited.

By adjusting the opening degree of the first pressure control valve (171), an excessive increase in the pressure of the target air in the water separation module (130) can be avoided. As a result, damage to the water separation membranes (134) can be prevented in advance, and the reliability of the air control system (100) can be enhanced.

(5-3)

In the air control system (100) of this embodiment, the second pressure control valve (172) is provided in the first supply path (102*a*). The second pressure control valve (172) decompresses the first air having flowed out of the gas separation module (120). Thus, in the gas separation module (120) located upstream of the second pressure control valve (172), the pressure of air flowing inside the tubular gas separation membranes (124) is maintained at a certain level or higher. As a result, the amount of oxygen and carbon dioxide permeating through the gas separation membranes (124) can be ensured, and the gas separation performance of the gas separation module (120) can be reliably exhibited.

The amount of oxygen and carbon dioxide permeating through the gas separation membranes (124) can be adjusted by adjusting the opening degree of the second pressure control valve (172) to change the pressure of the air flowing inside the tubular gas separation membranes (124). Thus, according to this embodiment, the nitrogen concentration of the first air and the oxygen concentration or carbon dioxide concentration of the second air can be adjusted by adjusting the opening degree of the second pressure control valve (172).

(5-4)

In the air control system (100) of this embodiment, the first air or second air having flowed out of the gas separation module (120) toward the storage space (5) is supplied as purge gas to the water separation module (130) through the introduction path (107), and is supplied to the storage space (5) after having been applied with water molecules having permeated through the water separation membranes (134). As described above, in the air control system (100) of this embodiment, water vapor removed from the target air in the water separation module (130) can be returned to the first air or second air flowing toward the storage space (5). Thus, according to this embodiment, the water separation module (130) is provided so that degradation of the performance of the gas separation membranes (124) due to water vapor can be avoided while a decrease in the humidity of air in the storage space (5) is suppressed.

(6) Variations of First Embodiment

Figure 13:
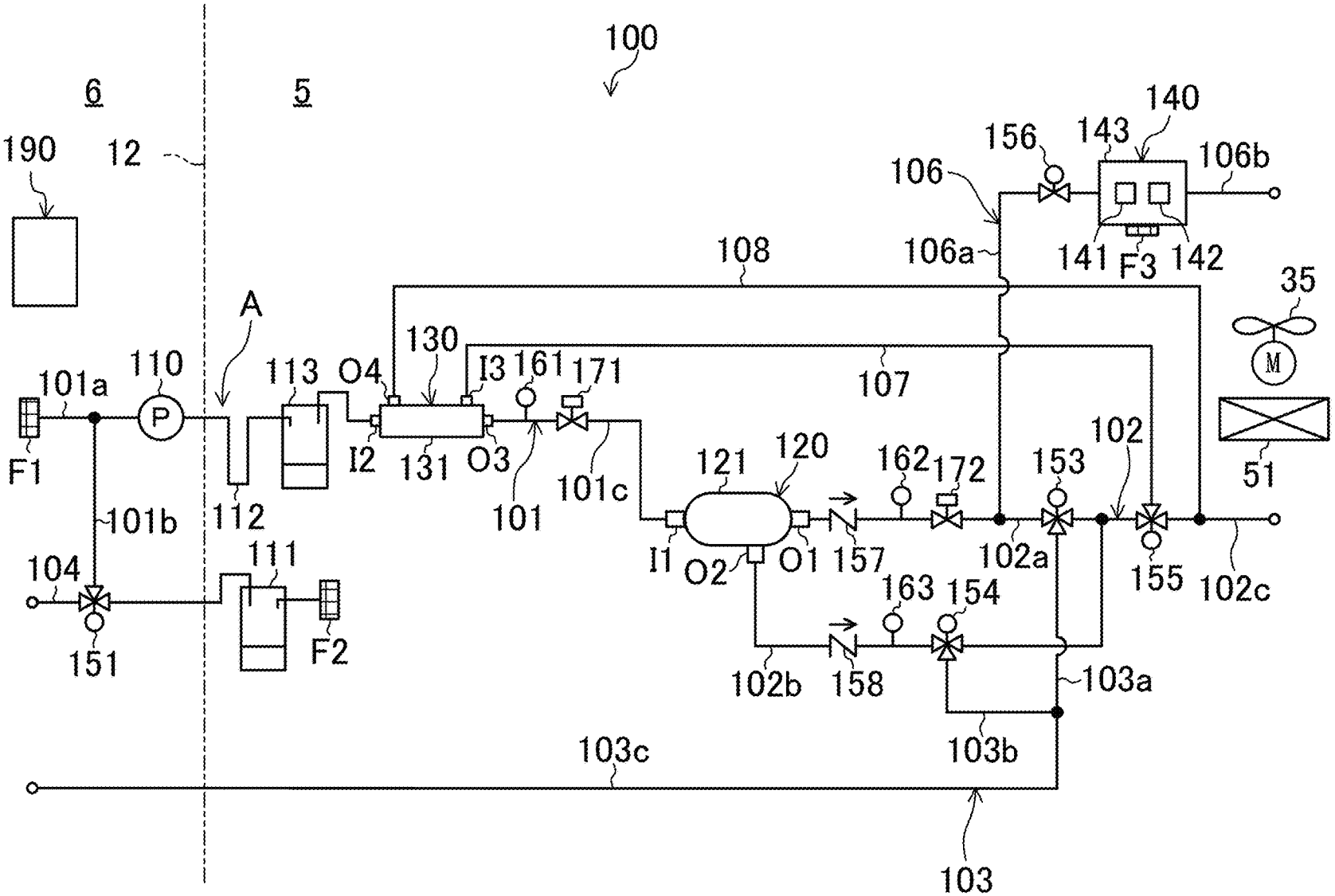
FIG. 13 is a diagram corresponding to FIG. 5 and illustrating an air control system of a variation of the first embodiment.

In the air control system (100) of this embodiment, the bypass flow path (105) may be omitted. An air control system (100) of this variation illustrated in FIG. 13 is devoid of the bypass flow path (105) and the second switching valve (152).

The air control system (100) of this variation can perform the first to fifth operations as in the air control system (100) illustrated in FIG. 5. In the fifth operation of the air control system (100) of this variation, both the third switching valve (153) and the fourth switching valve (154) are in the first state. In the fifth operation, both the first supply path (102*a*) and the second supply path (102*b*) communicate with the supply trunk path (102*c*), and the first air and second air having flowed out of the gas separation module (120) flow into the supply trunk path (102*c*) and are mixed with each other. Thus, the composition of the air supplied from the supply trunk path (102*c*) to the storage space is substantially the same as the composition of the target (i.e., outside air) flowing into the gas separation module (120).

Second Embodiment

A second embodiment will be described. A transport container (1) of this embodiment has a modified configuration of the air control system in the transport container (1) of the first embodiment.

(7) Air Control System

The air control system (100) of this embodiment will be described mainly in terms of differences from the air control system (100) of the first embodiment.

Figure 14:
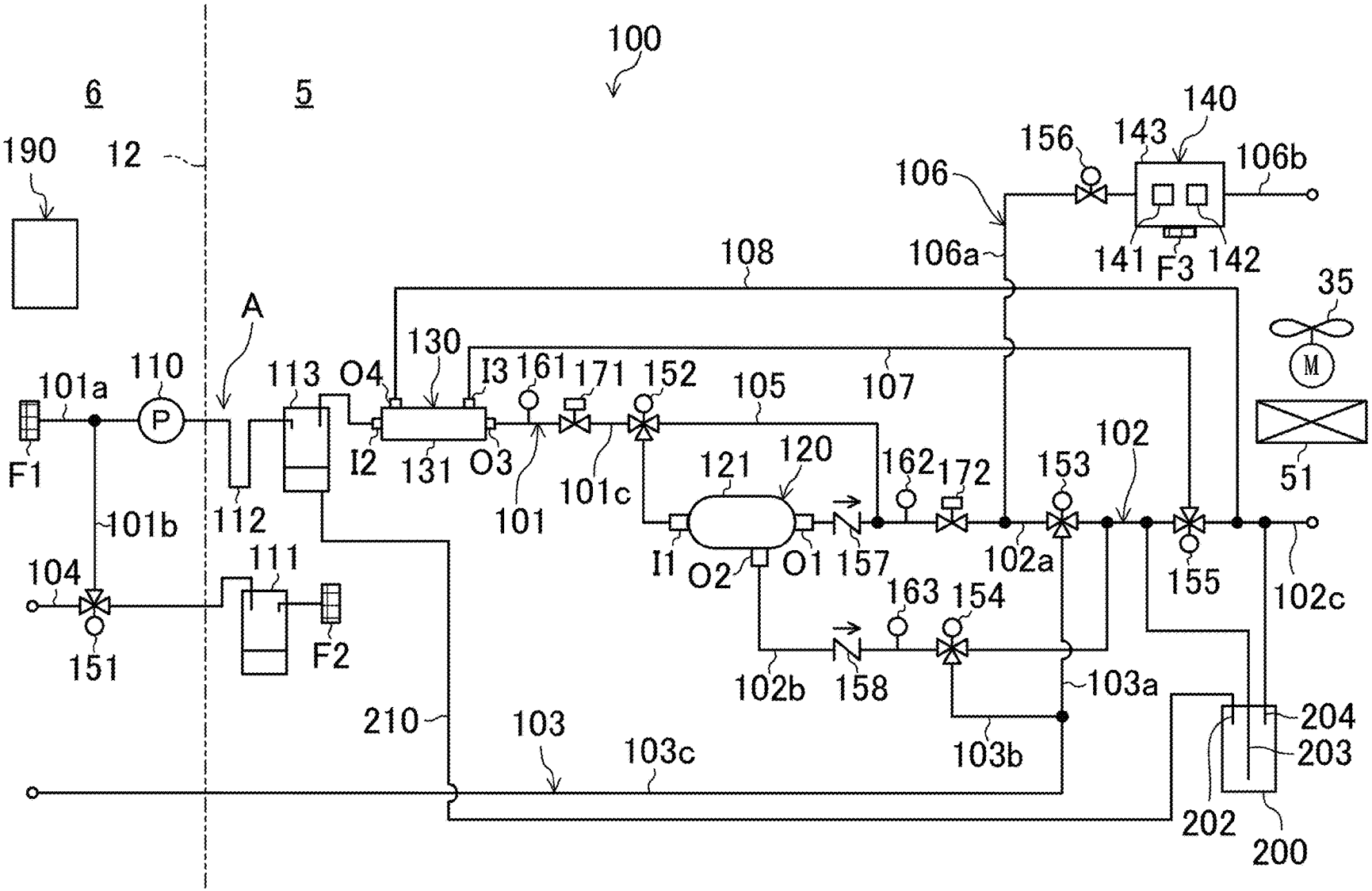
FIG. 14 is a diagram corresponding to FIG. 5 and illustrating an air control system of a second embodiment.

As illustrated in FIG. 14, the air control system (100) of this embodiment is obtained by adding a humidifier (200) and a water pipe (210) to the air control system (100) of the first embodiment.

(7-1) Water Pipe

The water pipe (210) has one end connected to the bottom of the second water separator (113) and the other end connected to the humidifier (200). The water pipe (210) is a pipe for sending water (liquid) accumulated in the second water separator (113) to the humidifier (200).

(7-2) Humidifier

The humidifier (200) is a humidifying unit configured to apply water vapor to the first air or second air to be supplied to the storage space (5). The humidifier (200) of this embodiment applies water vapor to the first air or second air flowing through the supply flow path (102).

Figure 15:
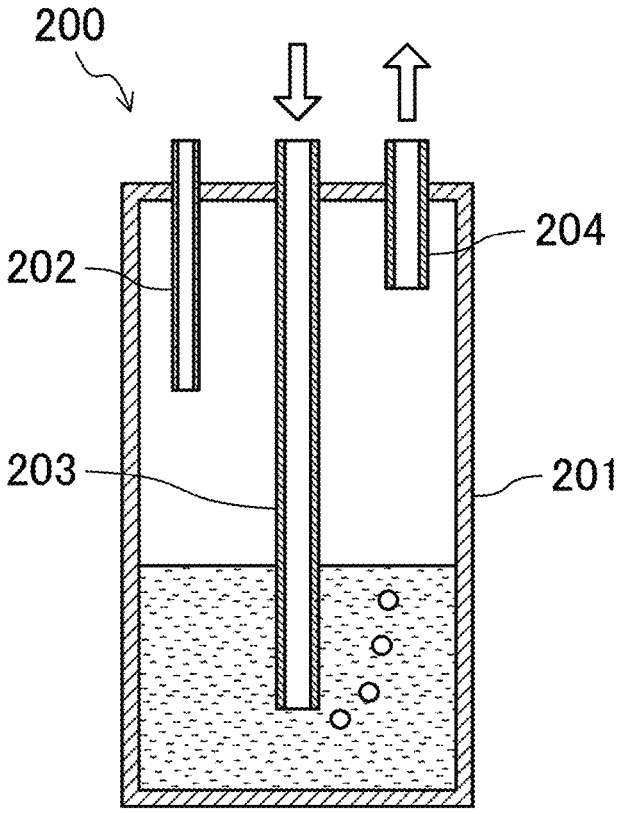
FIG. 15 is a schematic sectional view of a humidifier of the second embodiment.

As illustrated in FIG. 15, the humidifier (200) includes a main container (201), a water introduction pipe (202), an air introduction pipe (203), and an air exhaust pipe (204). The main container (201) is a standing cylindrical closed container. Each of the water introduction pipe (202), the air introduction pipe (203), and the air exhaust pipe (204) is a tubular member, and penetrates an upper end portion of the main container (201).

The other end of the water pipe (210) is connected to the water introduction pipe (202). The main container (201) stores water (liquid) having flowed from the second water separator (113) through the water pipe (210) and the water introduction pipe (202).

The air introduction pipe (203) is connected to the supply trunk path (102*c*) upstream of the fifth switching valve (155). The air introduction pipe (203) opens at the bottom of the internal space of the main container (201). The air introduction pipe (203) injects the first air or second air having flowed in from the supply trunk path (102*c*) into the water (liquid) accumulated on the bottom of the main container (201). In the main container (201), part of the water accumulated on the bottom turns into water vapor, which is applied to air having flowed in through the air introduction pipe (203).

The air exhaust pipe (204) is connected to the supply trunk path (102*c*) downstream of the fifth switching valve (155). The air exhaust pipe (204) opens at the top of the internal space of the main container (201). The air exhaust pipe (204) sends air, to which water vapor has been added in the internal space of the main container (201), toward the supply trunk path (102*c*).

(8) Features of Second Embodiment

According to the air control system (100) of this embodiment, the first air or second air to be supplied to the storage space (5) can be humidified by the humidifier (200). This can maintain the humidity of the air in the storage space (5) and can reduce degradation of the freshness of the fresh products stored in the storage space (5).

(9) Variations of Second Embodiment (9-1) First Variation

Figure 16:
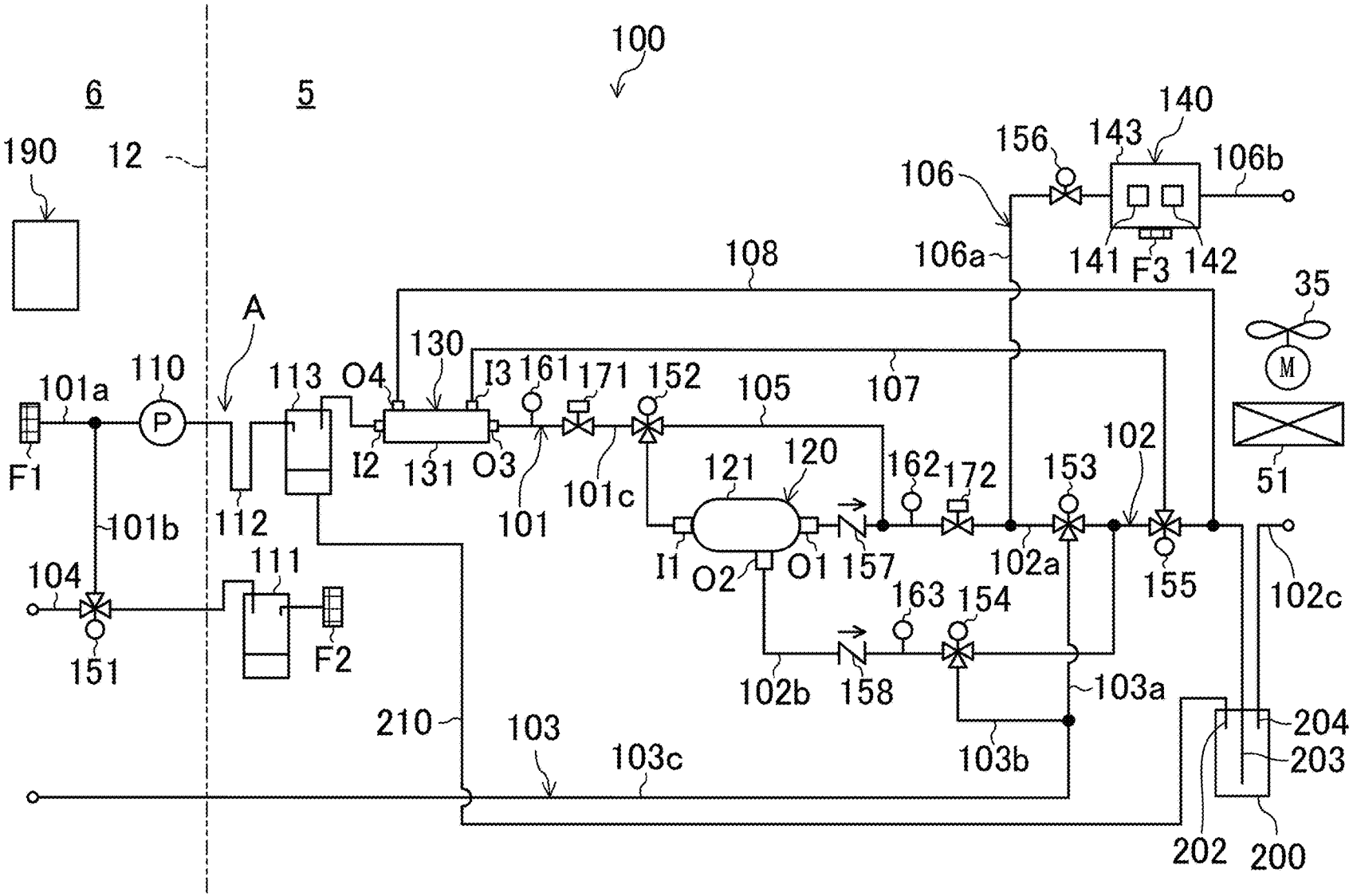
FIG. 16 is a diagram corresponding to FIG. 5 and illustrating an air control system of a variation of the second embodiment.

As illustrated in FIG. 16, in the air control system (100) of this embodiment, the humidifier (200) may be provided in the middle of the supply trunk path (102*c*). Specifically, in this variation, the humidifier (200) is provided downstream of a junction position of the supply trunk path (102*c*) with the water supply path (108). A portion of the supply trunk path (102*c*) closer to the junction position of the water supply path (108) is connected to the air introduction pipe (203) of the humidifier (200). A portion of the supply trunk path (102*c*) closer to the outlet end of the supply trunk path (102*c*) is connected to the air exhaust pipe (204) of the humidifier (200).

(9-2) Second Variation

The humidifier (200) of this embodiment may be an ultrasonic humidifier. The humidifier (200) of this variation includes an ultrasonic vibrator formed of a piezoelectric element, for example. The ultrasonic vibrator is provided at the bottom of the main container (201). When the ultrasonic vibrator is in operation, water is atomized by vibration generated by the ultrasonic vibrator, and the atomized water is applied to air in the internal space of the main container (201).

(9-3) Third Variation

In the air control system (100) of this embodiment, the water pipe (210) may be connected to a drain pan of the refrigeration apparatus (10) for transport instead of the second water separator (113).

In the refrigeration apparatus (10) for transport, the drain pan is arranged below the internal heat exchanger (51). The refrigeration apparatus (10) for transport performs a defrosting operation of defrosting the internal heat exchanger (51) using the heater (52). During the defrosting operation, frost adhering to the internal heat exchanger (51) melts to generate water (liquid). The drain pan receives water having flowed down from the internal heat exchanger (51) during the defrosting operation. The water received by the drain pan flows into the main container (201) of the humidifier (200) through the water pipe (210), and is used to humidify air in the humidifier (200).

(9-4) Fourth Variation

The humidifier (200) of this embodiment may be configured to humidify the outside air and supply the humidified outside air to the supply trunk path (102*c*).

In the humidifier (200) of this variation, a pipe for sending the outside air to the humidifier (200) is connected to the air introduction pipe (203). The air exhaust pipe (204) is connected to the supply trunk path (102*c*). In the humidifier (200), water vapor is applied to the outside air having flowed into the main container (201) through the air introduction pipe (203). The outside air humidified in the main container (201) flows into the supply trunk path (102*c*) through the air exhaust pipe (204). As a result, the water vapor applied to the outside air in the main container (201) is applied to the first air or second air flowing through the supply trunk path (102*c*).

(10) Other Embodiments (10-1) First Variation

The air control system (100) of each of the above-described embodiments and variations may include a throttle mechanism, such as an orifice, having a fixed opening degree instead of the first pressure control valve (171). In other words, the first throttle mechanism of the air control system (100) is not limited to the first pressure control valve (171) which is the throttle mechanism having the variable opening degree, and may be a throttle mechanism, such as an orifice, having a fixed opening degree.

The air control system (100) of each of the above-described embodiments and variations may include a throttle mechanism, such as an orifice, having a fixed opening degree instead of the second pressure control valve (172). In other words, the second throttle mechanism of the air control system (100) is not limited to the second pressure control valve (172) which is the throttle mechanism having the variable opening degree, and may be a throttle mechanism, such as an orifice, having a fixed opening degree.

(10-2) Second Variation

In the air control system (100) of each of the above-described embodiments and variations, the fifth switching valve (155) may be omitted. In the air flow path (A) of this variation, the water separation module (130) is arranged in the middle of the supply trunk path (102*c*). Specifically, the end of an upstream portion of the supply trunk path (102*c*) is connected to the third inlet port (I3) of the water separation module (130), and the start end of a downstream portion of the supply trunk path (102*c*) is connected to the fourth outlet port (O4) of the water separation module (130).

(10-3) Third Variation

The transport container (1) of each of the above-described embodiments and variations may be used for land transport. In this case, the transport container (1) is conveyed by a land transporter such as a vehicle. Specifically, the transport container (1) is mounted on a trailer.

(10-4) Fourth Variation

The air control system (100) of each of the above-described embodiments and variations may be provided in a stationary warehouse. In this case, the air control system (100) is used to adjust the composition of air in the storage space (5) formed by the warehouse. In the storage space (5) of the warehouse provided with the air control system (100), fresh products such as fruits, vegetables, and flowers and ornamental plants are stored.

While the embodiments and variations thereof have been described above, it will be understood that various changes in form and details may be made without departing from the spirit and scope of the claims. The elements according to the embodiment, the variations thereof, and the other embodiments may be combined and replaced with each other.

The expressions of "first," "second," and "third" described above are used to distinguish the terms to which these expressions are given, and do not limit the number and order of the terms.

INDUSTRIAL APPLICABILITY

As can be seen from the foregoing description, the present disclosure is useful for an air control system, a refrigeration apparatus, and a transport container.

EXPLANATION OF REFERENCES

1 Transport Container
2 Container Body (Storage)
10 Refrigeration Apparatus for Transport (Refrigeration Apparatus)
30 Refrigerant Circuit
100 Air Control System
110 Air Pump
113 Second Water Separator (Gas-Liquid Separator)
120 Gas Separation Module (Composition Adjuster)
124 Gas Separation Membrane (Second Separation Membrane)
130 Water Separation Module (Dehumidifying Unit)
134 Water Separation Membrane (First Separation Membrane)
171 First Pressure Control Valve (First Throttle Mechanism)
172 Second Pressure Control Valve (Second Throttle Mechanism)
200 Humidifier (Humidifying Unit)

The invention claimed is:

1. An air control system for adjusting a composition of inside air a storage, the air control system comprising:
- a dehumidifying unit including:
  - a first divisional wall;
  - a second divisional wall; and
  - a plurality of water separation membranes extending between the first divisional wall and the second divisional wall, the plurality of water separation membranes allowing water vapor to permeate therethrough and configured to dehumidify target air; and
- a composition adjuster including:
  - a second separation membrane for separating the target air dehumidified by the dehumidifying unit into first air and second air having different compositions; and
  - a case housing the second separation membrane,
- wherein the case has therein:
  - a first space into which the second air flows, the second air having permeated through the second separation membrane; and
  - a second space into which the first air flows, the first air having not permeated through the second separation membrane, and
- the first air or second air having flowed out of the composition adjuster is supplied to the storage.

2. The air control system of claim 1, wherein
- the dehumidifying unit is configured to apply water vapor, which has permeated through the plurality of water separation membranes, to the first air or the second air having flowed out of the composition adjuster toward an inside of the storage.

3. The air control system of claim 1, further comprising:
- a humidifying unit configured to apply water vapor to the first air or second air having flowed out of the composition adjuster toward an inside of the storage.

4. The air control system of claim 1, further comprising:

a gas-liquid separator configured to separate water in a liquid state from the target air to be sent to the dehumidifying unit.

5. The air control system of claim 1, further comprising:

an air pump configured to supply the target air to the dehumidifying unit; and a first pressure control valve provided for a passage of the target air from the dehumidifying unit toward the composition adjuster.

6. The air control system of claim 5, wherein the composition adjuster takes air having not permeated through the second separation membrane as the first air and air having permeated through the second separation membrane as the second air, and the air control system further comprises a second pressure control valve provided for a passage of the first air having flowed out of the composition adjuster.

7. A refrigeration apparatus comprising:

the air control system of claim 1; and a refrigerant circuit configured to perform a refrigeration cycle to adjust an internal temperature of the storage.

8. A transport container comprising:

the refrigeration apparatus of claim 7; and a container body to which the refrigeration apparatus is attached and which forms the storage.

* * * * *